US009546446B2

(12) United States Patent
Fukushima et al.

(10) Patent No.: US 9,546,446 B2
(45) Date of Patent: Jan. 17, 2017

(54) HIGHLY FUNCTIONAL POLYETHYLENE FIBERS, WOVEN OR KNIT FABRIC, AND CUT-RESISTANT GLOVE

(75) Inventors: Yasunori Fukushima, Shiga (JP); Shoji Oda, Shiga (JP); Minoru Masuda, Shiga (JP); Akira Hamano, Shiga (JP); Kunio Nishioka, Shiga (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 166 days.

(21) Appl. No.: 13/503,561

(22) PCT Filed: Oct. 10, 2010

(86) PCT No.: PCT/JP2010/068202

§ 371 (c)(1),
(2), (4) Date: Apr. 23, 2012

(87) PCT Pub. No.: WO2011/049026

PCT Pub. Date: Apr. 28, 2011

(65) Prior Publication Data

US 2012/0204322 A1 Aug. 16, 2012

(30) Foreign Application Priority Data

Oct. 23, 2009 (JP) ..... 2009-244846
Oct. 23, 2009 (JP) ..... 2009-244847

(51) Int. Cl.
*D06P 3/79* (2006.01)
*D01D 5/247* (2006.01)
(Continued)

(52) U.S. Cl.
CPC ..... *D06P 3/794* (2013.01); *D01D 5/247* (2013.01); *D01F 1/08* (2013.01); *D01F 6/04* (2013.01);
(Continued)

(58) Field of Classification Search
CPC ..... D01D 5/247; D01F 1/08; D01F 6/04; D01F 8/06; D03D 1/0041; D06P 3/794; A41D 19/01505; A41D 31/0055; Y10T 428/2978; Y10T 428/2929; Y10T 442/291; D06M 2101/18
See application file for complete search history.

(56) References Cited

U.S. PATENT DOCUMENTS 3,132,194 A * 5/1964 Edmonds, Jr. ..... D01D 5/247 264/129
4,413,110 A * 11/1983 Kavesh ..... D01F 6/02 264/164
(Continued)

FOREIGN PATENT DOCUMENTS

DE WO 2007063049 A1 * 6/2007 ..... C08F 290/06
JP 61174416 8/1986
(Continued)

OTHER PUBLICATIONS

Choy et al., Thermal Conductivity of Gel-Spun Polyethylene Fibers, 1993, Journal of Polymer Science Part B: Polymer Physics, vol. 31, pp. 365-370.*
(Continued)

*Primary Examiner* — Scott R Walshon
(74) *Attorney, Agent, or Firm* — Fish & Richardson P.C.

(57) ABSTRACT

A polyethylene fiber characterized by having an intrinsic viscosity [η] of 0.8 dL/g or more and less than 5 dL/g; being composed of a repeating unit substantially derived from ethylene; having pores formed inside of the fiber; having an average diameter of the pores of ranging from 3 nm to 1 μm when the diameter is measured, by each pore being approximated by a column, at a contact angle of 140 degrees, in a mercury intrusion method; a porosity of the pores of ranging from 1.5% to 20%; and having a tensile strength greater than or equal to 8 cN/dtex.

18 Claims, 2 Drawing Sheets

(51) Int. Cl.

| | |
|---|---|
| ***D01F 1/08*** | (2006.01) |
| ***D01F 6/04*** | (2006.01) |
| ***D03D 1/00*** | (2006.01) |
| ***D01F 8/06*** | (2006.01) |
| *D06M 101/18* | (2006.01) |
| *A41D 19/015* | (2006.01) |

(52) U.S. Cl.

CPC ..... *D01F 8/06* (2013.01); *D03D 1/0041* (2013.01); *A41D 19/01505* (2013.01); *D06M 2101/18* (2013.01); *Y10T 428/2929* (2015.01); *Y10T 428/2978* (2015.01); *Y10T 442/291* (2015.04); *Y10T 442/30* (2015.04); *Y10T 442/40* (2015.04)

(56) References Cited

U.S. PATENT DOCUMENTS

| | | | | |
|---|---|---|---|---|
| 4,536,536 | A * | 8/1985 | Kavesh et al. | 524/462 |
| 4,956,446 | A * | 9/1990 | Takahashi et al. | 528/272 |
| 5,043,216 | A * | 8/1991 | Misoo et al. | 428/397 |
| 5,084,173 | A * | 1/1992 | Nitadori | B01D 69/02 210/321.89 |
| 5,126,219 | A * | 6/1992 | Howard et al. | 429/252 |
| 5,156,856 | A | 10/1992 | Iwasaki et al. | |
| 5,272,236 | A | 12/1993 | Lai et al. | |
| 5,278,272 | A | 1/1994 | Lai et al. | |
| 5,296,175 | A | 3/1994 | Iwasaki et al. | |
| 5,380,810 | A | 1/1995 | Lai et al. | |
| 5,395,471 | A | 3/1995 | Obijeski et al. | |
| 5,427,807 | A | 6/1995 | Chum et al. | |
| 5,480,712 | A | 1/1996 | Takahashi et al. | |
| 5,525,695 | A | 6/1996 | Lai et al. | |
| 5,562,958 | A | 10/1996 | Walton et al. | |
| 5,582,923 | A | 12/1996 | Kale et al. | |
| 5,591,390 | A | 1/1997 | Walton et al. | |
| 5,595,705 | A | 1/1997 | Walton et al. | |
| 5,613,987 | A | 3/1997 | Kuroki et al. | |
| 5,632,510 | A | 5/1997 | Morowitz | |
| 5,665,800 | A | 9/1997 | Lai et al. | |
| 5,674,342 | A | 10/1997 | Obijeski et al. | |
| 5,677,383 | A | 10/1997 | Chum et al. | |
| 5,685,128 | A | 11/1997 | Chum et al. | |
| 5,703,187 | A | 12/1997 | Timmers | |
| 5,747,594 | A | 5/1998 | deGroot et al. | |
| 5,763,547 | A | 6/1998 | Kolthammer et al. | |
| 5,773,106 | A | 6/1998 | deGroot et al. | |
| 5,773,155 | A | 6/1998 | Kale et al. | |
| 5,783,638 | A | 7/1998 | Lai et al. | |
| 5,792,534 | A | 8/1998 | deGroot et al. | |
| 5,844,045 | A | 12/1998 | Kolthammer et al. | |
| 5,847,053 | A | 12/1998 | Chum et al. | |
| 5,852,152 | A | 12/1998 | Walton et al. | |
| 5,863,665 | A | 1/1999 | Kale et al. | |
| 5,869,575 | A | 2/1999 | Kolthammer et al. | |
| 5,872,201 | A | 2/1999 | Cheung et al. | |
| 5,874,139 | A | 2/1999 | Bosiers et al. | |
| 5,917,000 | A * | 6/1999 | Tsai et al. | 528/288 |
| 5,968,575 | A | 10/1999 | Rasmussen | |
| 5,972,444 | A | 10/1999 | Patel et al. | |
| 5,977,251 | A | 11/1999 | Kao et al. | |
| 5,986,028 | A | 11/1999 | Lai et al. | |
| 6,013,819 | A | 1/2000 | Stevens et al. | |
| 6,025,448 | A | 2/2000 | Swindoll et al. | |
| 6,045,924 | A | 4/2000 | Bekele | |
| 6,060,567 | A | 5/2000 | Lai et al. | |
| 6,075,077 | A | 6/2000 | Timmers et al. | |
| 6,087,447 | A | 7/2000 | Stevens et al. | |
| 6,107,374 | A | 8/2000 | Stevens et al. | |
| 6,111,023 | A | 8/2000 | Chum et al. | |
| 6,136,937 | A | 10/2000 | Lai et al. | |
| 6,140,442 | A | 10/2000 | Knight et al. | |
| 6,194,532 | B1 | 2/2001 | Maugans et al. | |
| 6,248,851 | B1 | 6/2001 | Maugans et al. | |
| 6,306,969 | B1 | 10/2001 | Patel et al. | |
| 6,316,549 | B1 | 11/2001 | Chum et al. | |
| 6,348,555 | B1 | 2/2002 | Lai et al. | |
| 6,436,534 | B1 | 8/2002 | Knight et al. | |
| 6,448,341 | B1 | 9/2002 | Kolthammer et al. | |
| 6,448,355 | B1 | 9/2002 | Knight et al. | |
| 6,506,867 | B1 | 1/2003 | Lai et al. | |
| 6,534,612 | B1 | 3/2003 | Lai et al. | |
| 6,538,070 | B1 | 3/2003 | Cardwell et al. | |
| 6,538,080 | B1 | 3/2003 | Swindoll et al. | |
| 6,541,403 | B2 * | 4/2003 | Billarant et al. | 442/364 |
| 6,545,088 | B1 | 4/2003 | Kolthammer et al. | |
| 6,548,611 | B2 | 4/2003 | Lai et al. | |
| 6,562,081 | B2 * | 5/2003 | Saraf et al. | 8/529 |
| 6,566,446 | B1 | 5/2003 | Parikh et al. | |
| 6,670,432 | B1 | 12/2003 | Timmers | |
| 6,686,488 | B2 | 2/2004 | Wilson et al. | |
| 6,723,398 | B1 | 4/2004 | Chum et al. | |
| 6,737,484 | B2 | 5/2004 | Lai et al. | |
| 6,780,954 | B2 | 8/2004 | Lai et al. | |
| 6,806,326 | B2 | 10/2004 | Stevens et al. | |
| 6,849,704 | B2 | 2/2005 | Lai et al. | |
| 6,858,557 | B1 | 2/2005 | Stevens | |
| 6,884,857 | B1 | 4/2005 | Stevens et al. | |
| 6,899,950 | B2 | 5/2005 | Sakamoto et al. | |
| 6,906,141 | B2 | 6/2005 | Chum et al. | |
| 6,916,883 | B2 | 7/2005 | Parikh et al. | |
| 7,141,301 | B2 | 11/2006 | Sakamoto et al. | |
| 7,247,372 | B2 | 7/2007 | Sakamoto et al. | |
| 7,736,564 | B2 | 6/2010 | Sakamoto et al. | |
| 8,104,625 | B2 * | 1/2012 | Nagashima et al. | 210/500.27 |
| 2001/0041776 | A1 | 11/2001 | Lai et al. | |
| 2002/0065384 | A1 | 5/2002 | Knight et al. | |
| 2002/0128403 | A1 | 9/2002 | Stevens et al. | |
| 2003/0065203 | A1 | 4/2003 | Wilson et al. | |
| 2003/0078357 | A1 | 4/2003 | Lai et al. | |
| 2003/0120004 | A1 | 6/2003 | Lai et al. | |
| 2003/0149181 | A1 | 8/2003 | Kolthammer et al. | |
| 2003/0166784 | A1 | 9/2003 | Parikh et al. | |
| 2003/0195320 | A1 | 10/2003 | Lai et al. | |
| 2004/0062926 | A1 | 4/2004 | Sakamoto et al. | |
| 2004/0082741 | A1 | 4/2004 | Lai et al. | |
| 2004/0167286 | A1 | 8/2004 | Chum et al. | |
| 2005/0038195 | A1 | 2/2005 | Parikh et al. | |
| 2005/0118418 | A1 | 6/2005 | Sakamoto et al. | |
| 2005/0131170 | A1 | 6/2005 | Lai et al. | |
| 2005/0187352 | A1 | 8/2005 | Chum et al. | |
| 2005/0238875 | A1 | 10/2005 | Sakamoto et al. | |
| 2005/0260911 | A1 * | 11/2005 | Ochi et al. | 442/189 |
| 2007/0055043 | A1 * | 3/2007 | Nadkarni et al. | 528/272 |
| 2007/0190321 | A1 * | 8/2007 | Sakamoto et al. | 428/375 |
| 2010/0000031 | A1 * | 1/2010 | Sierakowski | C08F 290/06 8/552 |

FOREIGN PATENT DOCUMENTS

| | | |
|---|---|---|
| JP | 3227464 | 10/1991 |
| JP | 4327208 | 11/1992 |
| JP | 6033313 | 2/1994 |
| JP | 6228809 | 8/1994 |
| JP | 7268784 | 10/1995 |
| JP | 9087440 | 3/1997 |
| JP | 2915995 | 7/1999 |
| JP | 2002180324 | 6/2002 |
| JP | 3334082 | 8/2002 |
| JP | 2003055833 | 2/2003 |
| JP | 2003055834 | 2/2003 |
| JP | 2004019050 | 1/2004 |
| JP | 2006132006 | 5/2006 |
| JP | 3995263 | 8/2007 |
| WO | WO 9324686 | 12/1993 |
| WO | WO 9700353 | 1/1997 |

OTHER PUBLICATIONS

Choy, Thermal Conductivity of HIghly Oriented Polyethylene, 1978, Polymer, Abstract.*

(56) References Cited

OTHER PUBLICATIONS

Fujishiro et al., "Thermal Conductivity and Diffusivity of High-Strength Polymer Fibers", Jpn. J. Appl. Phys., 36, 5633-5637 (1997).
Fujishiro et al., "Draving Effect on Thermal Properties of High-Strength Polyethylene Fibers", Jpn. J. Appl. Phys., 37, 1994-1995 (1998).
International Search Report for PCT/JP2010/068202, dated Jan. 18, 2011.
Extended European Search Report dated Apr. 13, 2013 for EP counterpart application No. 10824875.8.
Furumiya, A. et al., "Relationship Between Molecular Characteristics and Physical Properties of Linear Low Density Polyethylenes," *Pure & Appl. Chem.*, (1985), 57(6):823-832.
Canadian Intellectual Property Office Action mailed Jul. 20, 2016 in corresponding Canadian patent Application No. 2,778,557.

* cited by examiner

HIGHLY FUNCTIONAL POLYETHYLENE FIBERS, WOVEN OR KNIT FABRIC, AND CUT-RESISTANT GLOVE

TECHNICAL FIELD

The present invention relates to a highly functional polyethylene fiber excellent in dyeability and cut-resistance, a woven/knitted textile containing the fiber, and cut-resistant gloves containing the fiber, and more particularly to a highly functional polyethylene fiber that enables reduction of leakage of an additive such as a dye after being dyed, and that is excellent in safety, and a woven/knitted textile and cut-resistant gloves using the same.

BACKGROUND ART

Conventionally, cotton which is a natural fiber, and an organic fiber are used as a cut-resistant raw material, and gloves into which such a fiber and the like are knitted are widespread in fields in which cut resistance is required.

Knitted products and woven products have been suggested which are produced by using spun yarns of a high strength fiber such as an aramid fiber so as to provide cut resistance. However, the knitted products and woven products have been unsatisfactory from the standpoint of fiber detachment and durability. On the other hand, another method in which cut resistance is enhanced by using a metal fiber together with an organic fiber or a natural fiber is attempted. However, the use of a metal fiber causes texture to become hard, thereby deteriorating flexibility.

As inventions for solving the aforementioned problems, textiles and gloves in which a polyethylene fiber having a high modulus is used are suggested (for example, see Patent Literature 1). However, the modulus of the fiber is excessively high, so that an index value of the textiles and the gloves obtained in a cut resistance measurement using a coup tester is 3.8 at best as well as the texture becomes hard. Further, in the textiles and gloves, the cut resistance is improved by increasing a strength and a modulus, so that thermal conductivity is also increased. Therefore, when fresh foods are handled by, for example, meatpacking company staffs, their hands are cooled, or, on the contrary, raw materials such as meat are thawed and softened due to heat of their hands, so that, for example, the raw material cannot be cut as intended, thereby deteriorating the workability.

Further, since a color of the fiber is transparent, it is necessary to impart various colors to the fiber depending on the application in general. In order to impart a color to the fiber, a method in which a coloring component such as a pigment is blended during a spinning process step, or a method in which filaments, woven/knitted textiles, and textile products are subjected to post-processing by using dyes, are known. In the former method, there is a problem that spinning operation efficiency is deteriorated. On the other hand, in the latter method, in a case where, for example, this method is used for gloves for meat market staff handling meats, there is a concern about safety for consumers when a contained substance such as a dye is removed. Although a polyethylene is disclosed in Patent Literature 1, the polyethylene is not excellent in dyeability, so that a fiber having only a white-based color can be obtained.

Some methods for dyeing an ultrahigh molecular weight polyethylene fiber have been suggested (for example, see Patent Literature 2 to 6). In Patent Literature 2, a solvent dyeing technique for performing dyeing with an organic solvent having an oil-soluble dye dissolved therein, is disclosed. However, in this method, load on workplaces, working staff, and environments is heavy, and this technique has not been put into practical use in general.

In Patent Literature 3, an ultrahigh molecular weight polyethylene, a solvent therefor, and a technique for performing dyeing by using a dye soluble in the solvent, are disclosed. However, there are problems that, for example, (a) the number of colors that can be used is limited, (b) an imparted color becomes lighter due to a drawing process step, and (c) breakage of filaments frequently occurs during the drawing process step due to an influence of a dye applied to the surface of a fiber, so that productivity is significantly deteriorated.

Patent Literature 4 discloses a technique in which water and a dye, that is soluble in a water-soluble organic solvent, a non-water-soluble organic solvent, are used. However, since an organic solvent is used in a dyeing process step, there is a problem that environmental pollution may be caused by a dye-stained liquid. Further, since only a surface layer is dyed, fastness to washing is not sufficient. Therefore, a satisfactory colored polyethylene fiber cannot be obtained.

In Patent Literature 5, a technique for applying a dye to a highly-oriented high-molecular weight polyethylene fiber by using a supercritical fluid, is disclosed. However, since cost for introducing facilities is high, this technique cannot be adopted in general at present.

In Patent Literature 6, a technique for dyeing an ultrahigh molecular weight polyethylene fiber by using a hydrophobic dye, is disclosed. However, when the dyeing at a temperature above 100° C. is performed, dynamic physical properties of the fiber are reduced. On the other hand, when the dyeing at about 100° C. under a normal pressure is performed, the fiber can be dyed in a light color only. Further, a color fastness which is required for repeated use by washing, dry-cleaning, or the like is insufficient. Therefore, this technique cannot be practically used for a woven/knitted textile, and the like.

In Patent Literature 7, a high strength polyethylene fiber is disclosed which is used as a resin reinforcing material and a cement reinforcing material, and which has, on the surface of the fiber, a porous structure for enhancing an adhesion to a resin, a cement, and the like. However, although the polyethylene fiber described above has a high tensile strength to some degree, a thermal conductivity is high, similarly to a typical polyethylene fiber, due to the fiber containing no pores inside the fiber.

Similarly to Patent Literature 1, there are also problems including a problem that (1) when fresh foods are handled by, for example, meat market staff, their hands are cooled, and a problem that (2) raw materials such as meat are thawed and softened due to heat of their hands, so that, for example, the raw material cannot be cut as intended, therefore working efficiency is deteriorated.

Further, the fiber has a structure including a lot of pores on the surface of the fiber, thereby deteriorating cut-resistance. Thus, for example, it is difficult to practically use the fiber for a protective purpose requiring high cut-resistance.

Thus, a highly functional fiber that is excellent in heat-retaining property, cut-resistance, and dyeability, and that satisfies requirements from the market, and a protective woven/knitted textile and a cut-resistant glove using the fiber have not been completed yet at present.

PATENT LITERATURE

PTL 1: Japanese published unexamined application No. 2004-19050

PTL 2: Japanese published unexamined application No. H4-327208

PTL 3: Japanese published unexamined application No. H6-33313

PTL 4: Japanese published unexamined application No. 2006-132006

PTL 5: Japanese patent No. 3995263

PTL 6: Japanese published unexamined application No. H7-268784

PTL 7: Japanese published unexamined application No. H6-228809

SUMMARY OF THE INVENTION

Problems to be Solved by the Invention

In order to solve the aforementioned conventional problems, an object of the present invention is to make available a highly functional polyethylene fiber that has cut-resistance, that enables achievement of a high dye exhaustion rate in a simple dyeing process, that can be dyed in a deep color, and that is excellent in color fastness. Further, another object of the present invention is to make available a woven/knitted textile that uses the highly functional polyethylene fiber, and that is excellent in cut-resistance and heat-retaining property, and a glove thereof.

Solution to the Problems

As described above, it has been impossible to obtain an ultrahigh molecular weight polyethylene fiber that has an excellent dynamic property, and a remarkably improved dyeability, due to a molecular structure of a polyethylene even if a dye and an aid thereof are improved. However, the present inventor have focused on and thoroughly studied a higher-order structure of a polyethylene fiber, to achieve the present invention.

The present invention includes aspects as described below;

A polyethylene fiber comprises a polyethylene, wherein (1) an intrinsic viscosity [η] is greater than or equal to 0.8 dL/g, and less than 5 dL/g, (2) a repeating unit of the polyethylene is substantially ethylene, (3) pores are formed from a surface of the fiber to an inside of the fiber, (4) an average diameter for the pores ranges from 3 nm to 1 μm when the diameter is measured, by each pore being approximated by a column, at a contact angle of 140 degrees, in a mercury intrusion method, and (5) a porosity of the pores ranges from 1.5% to 20%, or (6) a thermal conductivity in a fiber axis direction at a temperature of 300 K ranges from 6 W/mK to 50 W/mK.

The polyethylene fiber preferably contains an organic substance having a high affinity for a disperse dye and a polyethylene.

As the organic substance having the high affinity for the disperse dye and the polyethylene, it preferably contains at least one kind of polyether compounds each having a molecular weight greater than or equal to 500.

Further, the organic substance is preferably contained in the polyethylene fiber at a proportion of the organic substance to the polyethylene fiber ranging from 0.005 mass % to 10.0 mass %.

Furthermore, it is preferable that the polyethylene fiber has an exhaustion rate of greater than or equal to 17%, in which the exhaustion rate is obtained when dyeing is performed at 100° C. at a bath ratio of 1:100 for 90 minutes by using a dye liquor that is prepared to have such a concentration as to contain 0.4 g/L of the disperse dye (Diaceliton fast Scarlet B (CI Disperse Red1)) and 1 g/L of a dyeing aid (DisperTL).

The polyethylene fiber preferably has a weight average molecular weight (Mw) of the polyethylene ranging from 50,000 to 600,000, and a ratio (Mw/Mn) of the weight average molecular weight to a number average molecular weight (Mn) of less than or equal to 5.0.

It is preferable that the polyethylene fiber has a specific gravity of greater than or equal to 0.90, a tensile strength of greater than or equal to 8 cN/dtex, and a modulus ranging from 200 cN/dtex to 750 cN/dtex.

Additionally, the present invention includes a dyed polyethylene fiber which is dyed with a disperse dye. The dyed polyethylene fiber preferably has an evaluation value of a fastness to washing in compliance with JIS L-0844 A-1 or/and an evaluation value of a fastness to dry cleaning in compliance with JIS L-0860 Method A-1 of higher than or equal to grade 3.

The present invention also includes a covered elastic yarn comprising an elastic fiber being covered by the polyethylene fiber or the dyed polyethylene fiber; a protective woven/knitted textile comprising, as at least a portion of the protective woven/knitted textile, the polyethylene fiber, the dyed polyethylene fiber, or the covered elastic yarn, wherein the protective woven/knitted textile has an index value of a coup tester of greater than or equal to 3.9; and a cut-resistant glove comprising the protective woven/knitted textile. The index value of the coup tester represents a scale for cut-resistance, and the greater the index value is, the more excellent the cut-resistance is.

Advantageous Effects of the Invention

The polyethylene fiber of the present invention enables a high dye exhaustion rate to be achieved when a dyeing is performed at 100° C. by using an aqueous method, and the polyethylene fiber of the present invention is excellent in color fastness. Further, any color for dyeing can be optionally selected, thereby enabling various dyed products to be formed. Further, the polyethylene fiber of the present invention is excellent in mechanical strength, and can be dyed under a mild condition as described above, thereby enabling reduction in dynamic physical properties of the fiber in a dyeing process step to be restrained. Therefore, when the polyethylene fiber of the present invention is used, a colorful and lightweight woven/knitted textile having an excellent heat-retaining property and an excellent cut-resistant can be provided.

DESCRIPTION OF EMBODIMENTS

Figure 1:
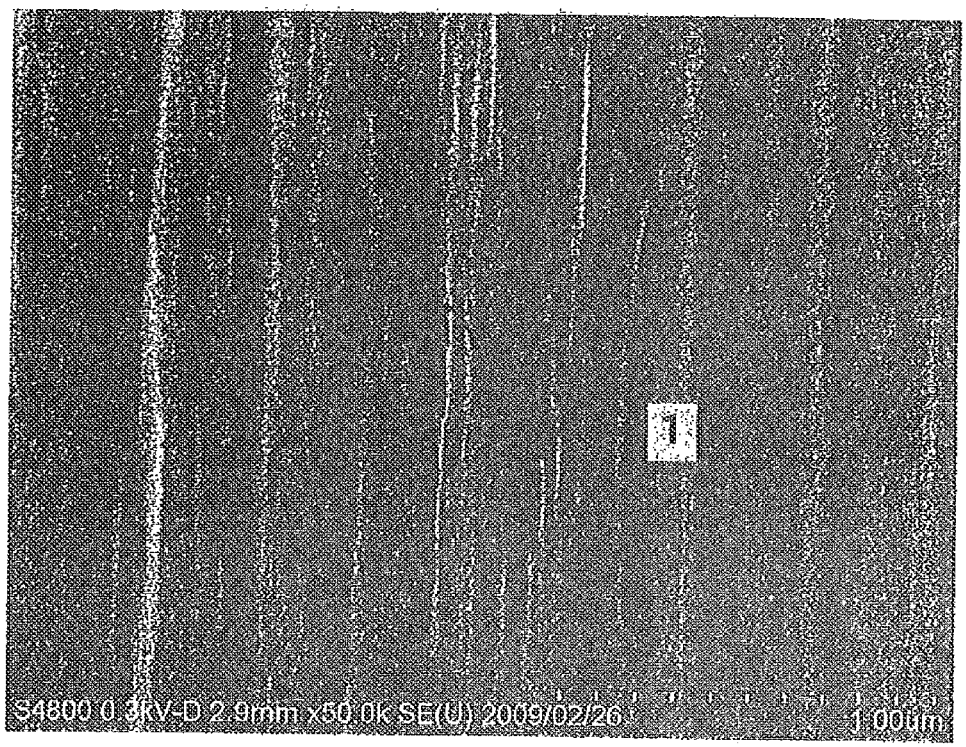
FIG. 1 is a photograph (the magnification: 50000×) that represents a surface of a polyethylene fiber of the present invention, and that is taken by a scanning electron microscope (SEM).

Hereinafter, the present invention will be described in detail.

A polyethylene fiber excellent in dyeability according to the present invention contains a polyethylene resin as a raw resin material, and an intrinsic viscosity of the polyethylene resin is greater than or equal to 0.8 dL/g, and is less than 5.0 dL/g, is preferably greater than or equal to 1.0 dL/g, and is preferably not greater than 4.0 dL/g, and is more preferably greater than or equal to 1.2 dL/g, and is more preferably not greater than 2.5 dL/g. When the intrinsic viscosity of the polyethylene resin which is the raw resin material is less than 5.0 dL/g, production of filaments by a melt spinning method is facilitated, and it is unnecessary to produce the filaments by using a so-called gel spinning, or the like. Therefore, the polyethylene fiber is superior in reduction of production cost, and simplification of working process steps. Further, in the melt spinning method, since no organic solvent is used for producing the fiber, influence on the environments is small. On the other hand, when the intrinsic viscosity is greater than or equal to 0.8 dL/g, reduction of terminal groups of a molecule of a polyethylene leads to reduction of the defects of structure in the fiber. Therefore, cut resistance and dynamic physical properties of the fiber, such as a strength and a modulus, can be improved.

A weight average molecular weight of a polyethylene as the raw resin material preferably ranges from 50,000 to 600,000. The weight average molecular weight more preferably ranges from 70,000 to 280,000, and even more preferably ranges from 90,000 to 124,000. A ratio (Mw/Mn) of the weight average molecular weight to a number average molecular weight is preferably less than or equal to 5.0. The ratio is more preferably less than or equal to 4.0, and is even more preferably less than or equal to 3.0. The ratio (Mw/Mn) of the weight average molecular weight to the number average molecular weight is preferably not less than 1.2. The ratio is more preferably not less than 1.5, and is even more preferably not less than 1.8. The weight average molecular weight and the number average molecular weight each represent a value that is obtained by measurement being performed in a method described in examples.

A specific gravity of the polyethylene used in the present invention is preferably greater than or equal to 0.910 g/cm$^3$, and is preferably not greater than 0.980 g/cm$^3$. The specific gravity is more preferably greater than or equal to 0.920 g/cm$^3$, and is more preferably not greater than 0.975 g/cm$^3$, and is even more preferably greater than or equal to 0.930 g/cm$^3$, and is even more preferably not greater than 0.970 g/cm$^3$.

Preferably, the polyethylene used in the present invention substantially contains ethylene as a repeating unit. Further, in a range in which effects of the present invention can be obtained, not only an ethylene homopolymer but also a copolymer of ethylene and a small amount of another monomer can be used. Examples of the other monomer include α-olefins, acrylic acid and derivatives thereof, methacrylic acid and derivatives thereof, and vinyl silane and derivatives thereof. A copolymer of an ethylene homopolymer and the other monomer that is different from ethylene, may be used. Further, a blended component of two or more kinds of copolymers, or a blended component of an ethylene homopolymer and a homopolymer of the other monomer such as an α-olefin, may be used. Furthermore, a partial crosslinked structure between an ethylene homopolymer and another (co)polymer, or between each (co)polymer, may be contained.

However, an excessive increase of a content of a copolymer component other than ethylene rather prevents drawing. Therefore, in light of obtaining a high strength fiber excellent in cut-resistance, a content of each of the other monomers such as an α-olefin is preferably less than or equal to 5.0 mol %, and is more preferably less than or equal to 1.0 mol %, and is even more preferably less than or equal to 0.2 mol %. Needless to say, the raw resin material may be an ethylene homopolymer.

A method for producing the polyethylene used as the raw resin material is not limited to any specific method. The monomer described above may be polymerized in a conventionally known method such as a slurry method, a solution polymerization method, a gas phase polymerization method, or the like. Further, for the polymerization reaction, a conventionally known catalyst may be used. As the method for producing the polyethylene used as the raw resin material, methods described in, for example, Japanese Patent No. 2915995, Japanese Patent No. 3334082, and Japanese Patent No. 3561562 can be employed.

The present invention has, as one of the essential features, a feature that a porous structure is formed inside the fiber in addition to in the surface of the fiber. Thus, a space in which a dye is retained can be ensured inside the fiber. In general, when the porous structure is formed inside the fiber, the porous structure becomes a defect of the fiber, so that the dynamic physical properties such as cut-resistance are significantly deteriorated. However, in the present invention, the highly functional polyethylene fiber in which a dye applied to the fiber is less likely to be removed due to characteristics of the porous structure as described below, and, further, due to a molecular characteristic of the polyethylene in combination therewith, cut-resistance that is the essential object becomes excellent, can be formed.

The highly functional polyethylene fiber excellent in dyeability according to the present invention has pores from the surface of the fiber to the inside thereof. Namely, pores are formed in the surface and the inside of the fiber (see FIGS. 1 to 3).

FIG. 1 illustrates a 50000×SEM photograph of the surface of the highly functional polyethylene fiber of the present invention, and pores (black portion) are observed in an inside portion surrounded by an ellipse.

Figure 2:
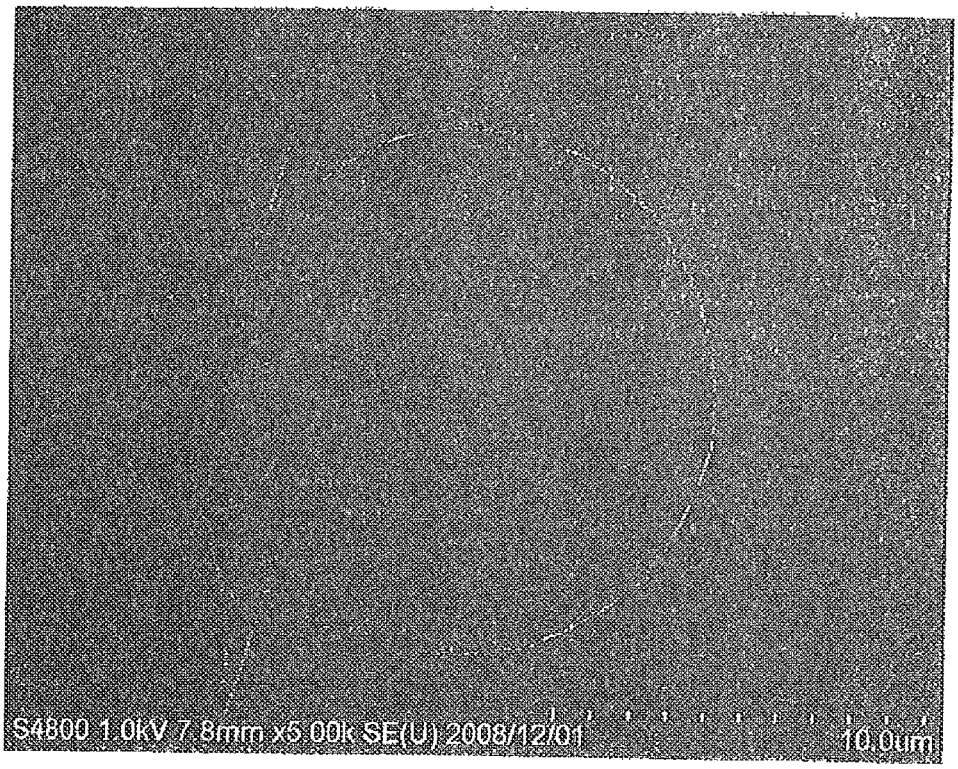
FIG. 2 is a SEM photograph (the magnification: 5000×) of a cross-section of the polyethylene fiber of the present invention which is vertically cut in a direction orthogonal to a fiber axis.
Figure 3:
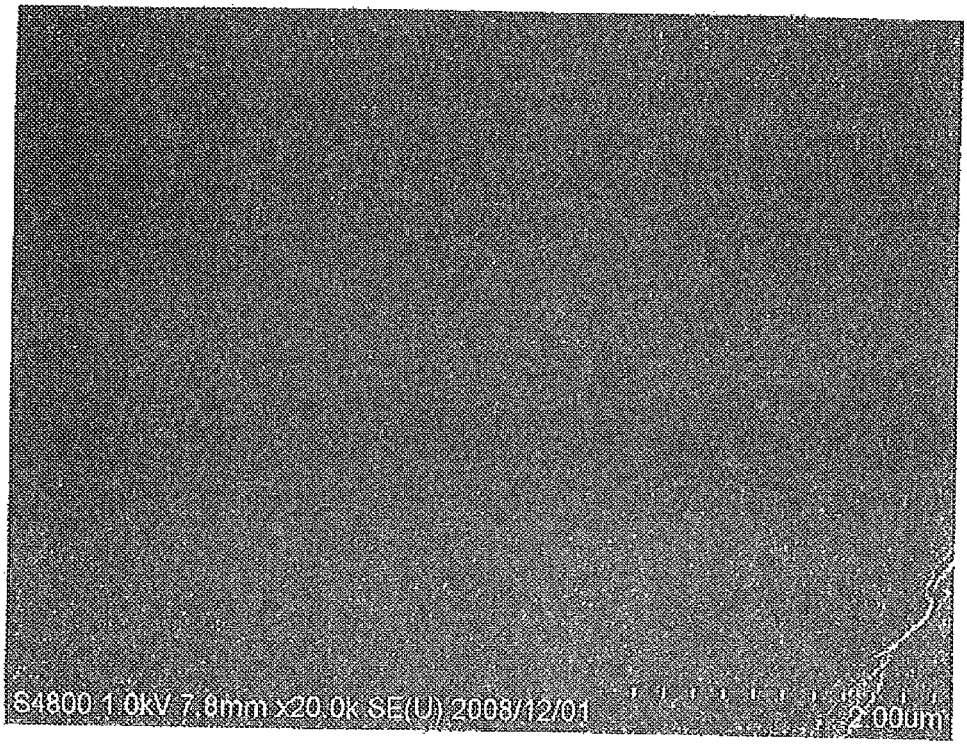
FIG. 3 is a SEM photograph (the magnification: 20000×) of the cross-section of the polyethylene fiber of the present invention which is vertically cut in the direction orthogonal to the fiber axis.

Further, FIG. 2 and FIG. 3 each illustrate a SEM photograph of a cross-section of the highly functional polyethylene fiber of the present invention which is vertically cut in a direction orthogonal to a fiber axis. The magnification is 5000× in FIG. 2, and the magnification is 20000× in FIG. 3.

Although it is not clear from these cross-sectional photographs that the pores inside the fiber communicate with the surface thereof, it can be inferred from the following phenomenon, for example, that a lot of pores extend from the surface so as to communicate with the inside.

Namely, when a density of the polyethylene fiber of the present invention is measured by using a density gradient tube method, the density of the polyethylene fiber is increased over the passage of time. It can be assumed that this is because a solvent in a density gradient tube replaces air contained in the pores inside the fiber due to capillary phenomenon.

The polyethylene fiber excellent in dyeability according to the present invention includes pores of which the average diameter ranges from 3 nm to 1 μm. Further, it is preferable that, when the fiber cross-section obtained by the polyethylene fiber of the present invention being vertically cut in a direction orthogonal to the fiber axis is observed by using a scanning electron microscope (SEM) at 20000× magnification, the number of the pores of which the average diameter ranges from 3 nm to 1 μm is greater than or equal to 0.05 per 1 $\mu m^2$. The average diameter of the pore is preferably greater than or equal to 8 nm, and is preferably not greater than 500 nm, and is more preferably greater than or equal to 10 nm, and is more preferably not greater than 200 nm, and is even more preferably greater than or equal to 15 nm, and is even more preferably not greater than 150 nm.

In a case where the average diameter of the pore is not greater than 1 μm, when the polyethylene fiber having the pores is dyed, and is used for a product such as a glove, removal of a dye can be restrained. Further, reduction of the dynamic physical properties and cut-resistance of the fiber can be restrained.

On the other hand, when the average diameter of the pore of the polyethylene fiber is limited to be greater than or equal to 3 nm, permeation of the dye into the fiber is facilitated, thereby improving dyeability.

When the number of the pores is greater than or equal to 0.05 per 1 $\mu m^2$, the dyeability is improved, and a hue of the colored fiber becomes favorable. The number of the pores is more preferably greater than or equal to 0.1, and is even more preferably greater than or equal to 0.2. The maximum number of the pores is not specified. However, when the number of the pores is excessively great, the drawing is likely to become difficult, and/or the dynamic physical properties of the fiber are likely to be reduced. The maximum number of the pores is determined according to an upper limit value of a porosity described below. Therefore, the maximum number of the pores is not restricted to any specific number when the porosity is within a range described below. However, when, for example, the average diameter of the pore is greater than or equal to 3 nm, and is less than 100 nm, the maximum number of the pores is preferably about 10000 per 1 $\mu m^2$, and is more preferably 8000 per 1 $\mu m^2$. When the average diameter of the pore is greater than or equal to 100 nm, the maximum number of the pores is preferably about 5000 per 1 $\mu m^2$, and is more preferably 1000 per 1 $\mu m^2$.

The number of the pores and the average diameter of the pore in the present invention can be obtained by using a mercury intrusion method and a nitrogen adsorption method in addition to the observation using a scanning electron microscope. In the observation using a scanning electron microscope, when a cross-section of the pore has an ellipsoidal shape or a polygonal shape, a distance between two points which are on the outer circumference of the pore, and which are furthest from each other is used as the diameter. Further, a shape of the pore of the polyethylene fiber according to the present invention exhibits an anisotropy, and the pore may have a maximal diameter in a direction diagonal to the fiber axis in addition to a fiber axis direction or a direction orthogonal to the fiber axis direction.

The polyethylene fiber excellent in dyeability according to the present invention has a porosity that is greater than or equal to 1.5%, and is not greater than 20%. The porosity represents a rate of a volume of the pores in the fiber, and the porosity is preferably greater than or equal to 1.8%, and is preferably not greater than 15%, and is more preferably greater than or equal to 2.0%, and is more preferably not greater than 10%. The porosity exerts great influence on a dyeability, a thermal conductivity, a cut-resistance, and a tensile strength of the fiber. When the porosity is less than 1.5%, the dyeability is reduced, and a hue of a colored fiber is deteriorated, and further the thermal conductivity tends to be increased. On the other hand, when the porosity is greater than 20%, the pores rather behave as a defect of the structure due to increase of cavities, so that the cut-resistance and the tensile strength are likely to be reduced.

The porosity of the present invention represents a rate (%) of a volume of the pores each of which has a diameter that is greater than or equal to 3 nm, and is not greater than 1 μm, inside the fiber, and the porosity is obtained by a mercury intrusion method.

The average diameter of the pore is obtained by the pore being approximated by a column, and the porosity is calculated by using the following equation, on the condition that a mercury density is 13.5335 g/mL, and a contact angle is 140 degrees.

Porosity (%)=100×(volumetric capacity [mL] of pores each having a diameter ranging from 3 nm to 1 μm×mass [g] of sample)/(cell volumetric capacity−(mass [g] of mercury/density [g/mL] of mercury))

The porosity of the polyethylene fiber of the present invention may be also obtained by using a scanning electron microscope in addition to the mercury intrusion method.

The average diameter of the pore obtained by the mercury intrusion method is greater than or equal to 3 nm, and is not greater than 1 μm, similarly to the average diameter obtained through the observation using the scanning electron microscope. The average diameter is preferably greater than or equal to 8 nm, and is preferably not greater than 500 nm, and is more preferably greater than or equal to 10 nm, and is more preferably not greater than 200 nm, and is even more preferably greater than or equal to 15 nm, and is even more preferably not greater than 150 nm.

A thermal conductivity, in the fiber axis direction, of the highly functional polyethylene fiber of the present invention is preferably greater than or equal to 6 W/mK, and is preferably not greater than 50 W/mK. When the highly functional polyethylene fiber is used as gloves for working staff of meat market and fishery industries, it is preferable that body heat is not conveyed to meat or fish which are commodities as much as possible. When the thermal conductivity is greater than 50 W/mK, freshness of commodities is likely to be reduced, and, in particular, raw fish are partially softened, so that it is difficult to cut the fish straight.

Further, the commodities are often frozen, and when the thermal conductivity is excessively high, hands become cold and paralyzed, thereby deteriorating working efficiency. In a case where the thermal conductivity is less than 6 W/mK for, for example, a glove formed of the fiber of the present invention, it is difficult to feel a material such as raw fish. The thermal conductivity in the fiber axis direction is more preferably greater than or equal to 7 W/mK, and is more preferably not greater than 30 W/mK, and is particularly preferably greater than or equal to 8 W/mK, and is particularly preferably not greater than 25 W/mK.

In general, a polyethylene fiber that has no pore and is highly oriented and crystallized has a thermal conductivity greater than 50 W/mK. On the other hand, although the polyethylene fiber of the present invention is highly oriented and crystallized, pores are contained in the fiber from the surface to the inside thereof, so that the thermal conductivity in the fiber axis direction ranges from 6 W/mK to 50 W/mK. The thermal conductivity described in the present invention represents a thermal conductivity in the fiber axis direction at a measurement temperature of 300 K. A specific measurement method will be described in detail in examples.

The polyethylene fiber of the present invention is excellent in heat-retaining property because the pores may prevent heat from being conveyed in the fiber.

In the highly functional polyethylene fiber of the present invention, a tensile strength is preferably greater than or equal to 8 cN/dtex. This is because the usage of the polyethylene fiber having such a strength can be expanded so as to cover a usage which cannot be realized by general-purpose polyethylene fibers.

The tensile strength is more preferably greater than or equal to 10 cN/dtex, and is even more preferably greater than or equal to 11 cN/dtex. Although the upper limit of the strength need not be specified, the upper limit of tensile strength is preferably about 55 cN/dtex. It is difficult to obtain, by using a melt spinning method, a fiber having a tensile strength of greater than 55 cN/dtex, in terms of a technique and industrial manufacturing.

Further, the highly functional polyethylene fiber excellent in dyeability according to the present invention is likely to absorb energy of an edged tool, and even when the tensile strength is less than 15 cN/dtex, the cut-resistance is high. The reason is not clear. However, it is assumed that this may be due to the porous structure. Specifically, since the polyethylene fiber of the present invention includes the porous structure, an elasticity is applied in the fiber cross-sectional direction that is a direction in which the edged tool progresses, so that an energy dispersion efficiency is enhanced. Therefore, when the tensile strength is greater than or equal to 8 cN/dtex, a required cut-resistance may be satisfactorily obtained.

A modulus of the polyethylene fiber of the present invention is preferably greater than or equal to 200 cN/dtex, and is preferably not greater than 750 cN/dtex. When the polyethylene fiber has such a modulus, change in physical property and shape due to an external force applied to a completed product or during a product processing step is less likely to occur.

The modulus is more preferably greater than or equal to 250 cN/dtex, and is even more preferably greater than or equal to 300 cN/dtex. The initial elastic modulus is more preferably not greater than 730 cN/dtex, and is even more preferably not greater than 710 cN/dtex. The measurement methods for the tensile strength and the initial elastic modulus will be described in detail in examples.

In other words, when a polyethylene fiber has a tensile strength greater than or equal to 8 cN/dtex, a modulus greater than or equal to 200 cN/dtex, and a thermal conductivity within the range described above, it can be said that the fiber has the porous structure of the present invention.

A specific gravity of the polyethylene fiber of the present invention is preferably greater than or equal to 0.90. The specific gravity is more preferably greater than or equal to 0.91, and is even more preferably greater than or equal to 0.92. On the other hand, the specific gravity is preferably not greater than 0.99. The specific gravity is more preferably not greater than 0.97, and is even more preferably not greater than 0.95. When a fiber has a specific gravity within the range described above, it can be said that the fiber has the above-mentioned porosity and thermal conductivity that are the features of the present invention. The specific gravity of the polyethylene fiber can be obtained by using the density gradient tube method.

Preferably, in the polyethylene fiber excellent in dyeability according to the present invention, a polyethylene which is a raw resin material has the intrinsic viscosity described above, and has, when the polyethylene is in a fibrous state, a weight average molecular weight ranging from 50,000 to 600,000, and a ratio (Mw/Mn) of the weight average molecular weight to a number average molecular weight which is less than or equal to 5.0.

As described above, although the polyethylene fiber of the present invention has the porous structure (a void structure) in the surface and the inside of the fiber, the polyethylene fiber has a high strength and a high modulus, and is also excellent in cut-resistance. In order to adjust the molecular weight of the polyethylene fiber and a distribution of the molecular weights so as to be within the range described above, for example, a melt spinning method described below, or a method in which filaments obtained after the melt spinning are held in a heat-retaining section at a predetermined temperature, and are then quenched, may be adopted (see, for example, International Publication No. 93/024686, and Japanese published unexamined application No. 2002-180324).

Preferably, the polyethylene in a fibrous state has a weight average molecular weight of not less than 50,000, and not more than 300,000, a ratio (Mw/Mn) of the weight average molecular weight to a number average molecular weight of less than or equal to 4.0, more preferably the polyethylene in a fibrous state has a weight average molecular weight of not less than 65,000, and not more than 250,000, a ratio (Mw/Mn) of the weight average molecular weight to a number average molecular weight of less than or equal to 3.5.

The present invention has, as one of other essential features, a feature that the polyethylene fiber of the present invention contains an organic substance having a high affinity for each of a disperse dye and a polyethylene as well as contains the pores described above inside the fiber. According to the present invention, it is assumed that the organic substance is inside or near the pores.

A proportion of the organic substance to the polyethylene fiber is preferably greater than or equal to 0.005 mass %, and is preferably not greater than 10.0 mass %. A content of the organic substance is more preferably greater than or equal to 0.05 mass %, and is more preferably not greater than 8.0 mass %. The content of the organic substance is even more preferably greater than or equal to 0.2 mass %, and is even more preferably not greater than 5.0 mass %. When the content of the organic substance is greater than or equal to 0.005 mass %, a dye exhaustion rate tends to be enhanced. On the other hand, when the content thereof is not greater than 10.0 mass %, the organic substance is restrained from acting as impurities in the fiber, thereby obtaining a necessary cut-resistance.

The content of the organic substance in the polyethylene fiber of the present invention can be obtained by using an NMR method, which is adopted in examples, a gas chromatography method, or an infrared spectroscopy.

The organic substance may contain each of a component having a high affinity for a disperse dye, and a component having a high affinity for the polyethylene, and the organic substance may be either a mixture or a single compound. The organic substance may be, for example, a compound having a high affinity for both a disperse dye and the polyethylene, or a mixture of a compound having a high affinity for a disperse dye and a compound having a high affinity for the polyethylene.

The component having a high affinity for a disperse dye may be an organic substance that can adsorb the disperse dye, and/or enables the disperse dye to be dispersed or dissolved. Although the component having a high affinity for a disperse dye is not limited to any specific organic substance, and may be any organic substance that enables this action, preferable examples thereof include disperse dye dispersants, surfactant substances, and polyester-based compounds.

Examples of the disperse dye dispersant include polycyclic anionic surfactants such as naphthalene sulphonate formaldehyde condensates, Schaeffer's acid-cresol-formaldehyde condensates, and lignin sulfonic acids.

Examples of the surfactant substance include polyalkylene glycols such as polyethylene glycols, polypropylene glycols, and polybutylene glycols, and copolymers thereof, and surfactants such as polyvinyl alcohols, non-ionic surfactants, anionic surfactants, and cationic surfactants.

Examples of the surfactant include: an ester compound obtained by a reaction between a divalent fatty acid, and a compound in which a higher alcohol having 10 to 16 carbon atoms has ethylene oxide and propylene oxide added thereto; and polyether surfactants such as a higher alcohol alkylene oxide adduct having a molecular weight of 1000 to 3000, and a polyhydric alcohol alkylene oxide adduct.

Examples of the component having a high affinity for the polyethylene include: paraffins; alkylene glycols such as polyethylene glycols, polypropylene glycols, and polybutylene glycols; low molecular weight polyethylenes; polyethylene waxes; partially oxidized polyethylene waxes; and alkali metal salts of partially oxidized polyethylene waxes.

Further, examples of the component having a high affinity for both a disperse dye and the polyethylene include polyether compounds such as polyoxyethylenes, polyoxypropylenes, polyoxybutylenes, poly(oxyethylene-oxypropylene) random copolymers or block copolymers, and poly (oxyethylene-oxybutylene) random copolymers or block copolymers.

As the organic substance having a high affinity for a disperse dye and/or the polyethylene, one kind of the compounds described above as examples may be independently used, or two or more kinds of the compounds described above as examples may be used in combination. Specific examples of the polyether include polyoxyethylenes and polyoxybutylenes. As the polyether, the polyether having a molecular weight of greater than or equal to 500 is preferable, and the molecular weight is more preferably greater than or equal to 1,000, and is even more preferably greater than or equal to 2,000. On the other hand, the molecular weight thereof is not greater than 100,000, is preferably not greater than 50,000, and is more preferably not greater than 30,000. When the molecular weight thereof is greater than 100,000, a viscosity is increased, and it is difficult to perform application uniformly over the entirety of the fiber, which is unfavorable. As the organic substance according to the present invention, among the compounds described above as examples, an organic substance that contains at least one kind of the polyether compounds is preferably used.

The reason why the polyethylene fiber excellent in dyeability according to the present invention can be obtained is not clear, and the inventors of the present invention assume that this is due to the following mechanism.

Specifically, it is assumed that, since the fiber contains the pores formed inside the fiber, and the organic substance having a high affinity for both the imparted disperse dye and the polyethylene fiber, the dye permeates the inside of the fiber, and the dye is fixed in the porous structure described above, so that removal of the dye after products are obtained can be reduced to a minimal level.

Examples of a method for producing the polyethylene fiber excellent in dyeability according to the present invention include conventionally known production methods using, for example, a wet spinning, a dry spinning, a gel spinning, a melt spinning, and a liquid crystal spinning, and the method is not limited to a specific method. However, a melt spinning method is preferably employed. For example, in the gel spinning method which is one of methods for producing an ultrahigh molecular weight polyethylene fiber by using a solvent, although a high strength polyethylene fiber can be obtained, not only productivity is low, but also use of the solvent exerts a great influence on health of manufacturing staff and environments.

The polyethylene fiber of the present invention contains pores having a predetermined size, each in the surface of the fiber and inside the fiber. The pores can be formed in the surface of the fiber and inside the fiber when, for example, the following conditions are satisfied in the melt spinning method. However, the method for producing the polyethylene fiber of the present invention is not limited to this method.

In the melt spinning method, a raw resin material having been softened and melted is discharged from a spinneret (spinning nozzle) having a plurality of discharge holes perforated therein, to obtain filaments, thereby producing a fiber. A device that can be used in the present invention is not limited to any specific device. A conventionally known device such as a melt-spinning device that includes, for example, a melt-extrusion section for softening and melting a raw resin material, and a spinneret including nozzle holes used for spinning a melted resin into filaments, and a pump for quantitatively supplying the melted resin into the spinneret, can be used. According to the present invention, when the raw resin material is supplied to the melt-extruder, it is suggested that an inert gas is supplied such that a pressure in the melt-extruder is set to be preferably greater than or equal to 0.001 MPa, and be preferably not greater than 0.8 MPa, be more preferably greater than or equal to 0.05 MPa, and be more preferably not greater than 0.7 MPa, and be even more preferably greater than or equal to 0.1 MPa, and be even more preferably not greater than 0.5 MPa. A temperature for melting is not limited to any specific temperature, and the temperature may be determined as necessary according to a raw resin material to be used.

In general, in order to remove impurities contained in the melted resin, a filter is provided in a nozzle pack preceding the spinning nozzle (spinneret). In the present invention, a filter in which a diameter for a mesh is less than or equal to 100 μm, is preferably used. The diameter for the mesh is more preferably less than or equal to 50 μm, and is even more preferably less than or equal to 15 μm. Further, it is desirable that a spinning nozzle which has nozzle holes each having an orifice diameter ranging from 0.4 mm to 2.5 mm, is employed. A discharge linear velocity at which the melted resin is discharged from the spinning nozzle preferably ranges from 10 cm/min. to 120 cm/min. The discharge linear velocity more preferably ranges from 20 cm/min. to 110 cm/min., and even more preferably ranges from 30 cm/min. to 100 cm/min. Further, a single hole throughput for the melted resin preferably ranges from 0.2 g/min. to 2.4 g/min, more preferably ranges from 0.2 g/min. to 1.8 g/min., and even more preferably ranges from 0.3 g/min. to 1.2 g/min. In order to quantitatively discharge the melted resin from the spinneret, a gear pump or the like may be used.

Subsequently, the obtained filaments are cooled at a temperature ranging from 5° C. to 60° C., and non-drawn filaments are once taken up. For the cooling, a gas is typically used. However, a liquid may be used so as to enhance a cooling efficiency. For example, air or nitrogen is preferably used as the gas, and water is preferably used as the liquid. Subsequent thereto, the non-drawn filaments are drawn, thereby obtaining the polyethylene fiber of the present invention. The drawing process step is preferably performed at a high deformation speed.

Further, although the reason why specific fine pores are formed in the highly functional polyethylene fiber of the present invention is not clear, it is assumed that this is due to the following mechanism.

Namely, shearing is applied in the filter mesh and the orifices in the presence of a certain amount of inert gas before discharge, to form potential non-uniformity in the fiber, and drawing is performed in one action at a high drawing speed, to apply a high deformation stress, and a small difference in deformation followability in the fiber is actualized to form space in the fiber, so that extremely fine pores can be formed.

According to the present invention, it is preferable that the organic substance, as described above, having a high affinity for the disperse dye and the polyethylene is applied to the non-drawn filaments which have not been drawn. Applying the organic substance of the present invention prior to the drawing process step is one of the features of the present invention. Thus, a portion of the organic substance permeates the inside of the fiber before the drawing process step, or the organic substance is put into such a state as to easily permeate the inside of the fiber, so that the permeation of the organic substance into pores formed in the drawing process step, may be promoted.

The process step of applying the organic substance used in the present invention may be performed in any stage preceding the drawing process step. However, it is desirable that the process step of applying the organic substance is performed on the non-drawn filaments obtained after the raw resin material is discharged from the spinning nozzle. Further, after the organic substance is applied, the non-drawn filaments may be immediately transferred to the drawing process step, or the non-drawn filaments may be left as they are for a predetermined time period. If the organic substance is applied to the raw polyethylene resin material before the melt-extrusion process step, the organic substance is likely to be decomposed due to heat and shearing in the extrusion process step, and further the filter mesh may be clogged with the organic substance, so that the spinning productivity may be deteriorated.

A method for applying the organic substance is not limited to any specific method. For example, a method in which the non-drawn filaments are immersed in a liquid organic substance, or in an organic substance solution prepared by the organic substance being dispersed and dissolved in water or an organic solvent, or a method for applying or spraying the organic substance or the organic substance solution to the non-drawn filaments, may be used.

In the drawing process step, it is suggested that the temperature for the drawing is lower than 140° C., is preferably lower than or equal to 130° C., and is more preferably lower than or equal to 120° C. Thus, the pores are prevented from being blocked inside the fiber and becoming independent pores, and the pores in the fiber can remain penetrating (communicating with) the surface of the fiber. On the other hand, when the temperature for the drawing is higher than or equal to 140° C., it is assumed that a partial fusion bonding of the polyethylene causes the pores to be blocked inside the fiber, and permeation of the dye becomes difficult.

When the temperature for the drawing is lower than 140° C., the number of times the drawing process step is performed is not limited to any specific number of times, and one time drawing step may be performed or multiple times drawing steps including two or more times drawing steps may be performed. More preferably, it is suggested that the drawing process step may be performed in two or more stages. At the beginning of the drawing, the drawing is preferably performed at a temperature lower than an α-dispersion temperature of the polyethylene. Specifically, the drawing is preferably performed at 80° C. or a lower temperature, and is more preferably performed at 75° C. or a lower temperature. Further, pressure is applied to the fiber from the outside by using an inert gas during the drawing process step, so that the permeation of the organic substance used in the present invention, into the fiber, can be promoted.

A draw ratio is preferably greater than or equal to 6, is more preferably greater than or equal to 8, and is even more preferably greater than or equal to 10. The draw ratio is preferably not greater than 30, is more preferably not greater than 25, and is even more preferably not greater than 20. In a case where the multiple times drawing steps are adopted, when, for example, two times drawing steps are performed, the draw ratio for the first drawing step preferably ranges from 1.05 to 4.00, and the draw ratio for the second drawing step preferably ranges from 2.5 to 15. When the draw ratio is within the range described above, a fiber having the pore diameter and porosity described above is obtained. The deformation rate is preferably greater than or equal to 0.05 m/sec. based on the length of the non-drawn filament, is more preferably greater than or equal to 0.07 m/sec., and is even more preferably greater than or equal to 0.10 m/sec. The deformation rate is preferably not greater than 0.50 m/sec., is more preferably not greater than 0.45 m/sec., and is even more preferably not greater than 0.40 m/sec. When the deformation rate is too low, it is likely to be difficult to form the pores inside the fiber. On the other hand, when the deformation rate is excessively high, breakage of the filaments may occur. When the multiple times drawing steps including two or more times drawing steps are performed, at least the first drawing step is preferably performed at the deformation rate described above.

The highly functional polyethylene fiber of the present invention which has the porous structure described above, has a high exhaustion rate when the dyeing is performed by using the disperse dye. The dyed highly functional polyethylene fiber, according to the present invention, obtained by the dyeing being performed using the disperse dye has a deep color such as blue and/or black, and is practical and excellent in color fastness. Further, when the polyethylene fiber of the present invention also has, inside or near the porous structure, the organic substance having a high affinity for both the disperse dye and the polyethylene as described above, the exhaustion rate and the color fastness are further enhanced.

The polyethylene fiber excellent in dyeability according to the present invention preferably indicates an exhaustion rate that is greater than or equal to 17% when the polyethylene fiber is dyed for 90 minutes at 100° C. (an oil at 115° C. is used as a heating source) at a bath ratio of 1:100 relative to a dye liquor prepared to have such a concentration as to contain 0.4 g/L of a disperse dye (Diaceliton fast Scarlet B (CI Disperse Red1)) and 1 g/L of a dyeing aid (Disper TL). The exhaustion rate is more preferably greater than or equal to 20%, is even more preferably greater than or equal to 22%, and is still more preferably greater than or equal to 30%. The exhaustion rate is obtained by absorbances of the dye liquor being measured before and after dyeing.

When the polyethylene fiber is processed so as to be used as a woven/knitted textile, fastness to washing and fastness to dry-cleaning, which are important for putting the textile on human bodies and the like, need to be at a practical level in market. Therefore, according to the present invention, fastness to washing (JIS L-0844 A-1), and fastness to dry-cleaning (JIS L-0860 Method A-1, perchloroethylene) are used as a scale for the color fastness.

In a case where the polyethylene fiber of the present invention is used, the polyethylene fiber having been dyed indicates a fastness to washing (JIS L-0844 A-1) which is higher than or equal to grade 3, or a fastness to dry-cleaning (JIS L-0860 Method A-1, perchloroethylene) which is higher than or equal to grade 3, even when the fiber is dyed, in a simple dyeing process step, at 100° C. for about 30 minutes by using a disperse dye. Further, when the polyethylene fiber having been dyed is used, a dyed product having a color fastness equivalent to that of the polyethylene fiber having been dyed can be easily obtained.

A method for dyeing the polyethylene fiber of the present invention is not limited to any specific method, and any conventionally known dyeing method can be adopted. As a dye, a disperse dye is preferably used. The disperse dye holds one or some of various chromophores. Specific examples of the disperse dye include azo dyes, anthraquinone dyes, quinophthalone dyes, naphthalimide dyes, naphthoquinone dyes, and nitro dyes.

Examples of a commercially available disperse dye include C.I. Disperse Yellow 3, C.I. Disperse Yellow 5, C.I. Disperse Yellow 64, C.I. Disperse Yellow 160, C.I. Disperse Yellow 211, C.I. Disperse Yellow 241, C.I. Disperse Orange 29, C.I. Disperse Orange 44, C.I. Disperse Orange 56, C.I. Disperse Red 60, C.I. Disperse Red 72, C.I. Disperse Red 82, C.I. Disperse Red 388, C.I. Disperse Blue 79, C.I. Disperse Blue 165, C.I. Disperse Blue 366, C.I. Disperse Blue 148, C.I. Disperse Violet 28, and C.I. Disperse Green 9.

Further, the disperse dye can be selected from an appropriate database (for example, "Color Index"). Details of the disperse dyes and other examples of the disperse dye are described at pages 134 to 158 of "Industrial Dyes", edited by Klaus Hunger, Wiley-VCH, Weinheim, 2003. Therefore, the selection may be performed with reference thereto. Further, two or more kinds of the disperse dyes may be used in combination.

In order to provide other functions, an additive such as an antioxidant, a PH adjuster, a surface tension depressant, a viscosity improver, a moisturizing agent, a deep-coloring agent, an antiseptic agent, an antimold, an antistatic agent, a sequestering agent, and a reduction inhibitor, in addition to the disperse dye, may be used. These additives may be used, when the dyeing is performed, together with the disperse dye, to be applied to the polyethylene fiber of the present invention.

An application of the polyethylene fiber excellent in dyeability according to the present invention is not limited to any specific application. For example, the highly functional polyethylene fiber may be used as filaments. Alternatively, an elastic fiber may be used as a core yarn, and the polyethylene fiber of the present invention may be used as a sheath yarn, to obtain a covered elastic yarn. Further, woven/knitted textiles may be preferably produced by using the covered elastic yarn. When the covered elastic yarn of the present invention is used, the woven/knitted textile can provide enhanced wearing feeling, and facilitate putting-on and taking-off, and further light is absorbed and reflected by the pores (micro voids) formed in the surface and the inside of the polyethylene fiber of the present invention used as the sheath yarn, thereby providing an effect that embrittlement of the elastic fiber (core yarn) can be restrained. Further, when the covered elastic yarn contains the polyethylene fiber of the present invention, cut-resistance tends to be improved to some degree. Examples of the elastic fiber to be used as the core yarn of the covered elastic yarn include, but are not limited to, polyurethane fibers, polyolefin fibers, and polyester fibers. The elastic fiber described herein refers to a fiber representing a recovery property which is greater than or equal to 50% when elongated by 50%.

For a method for producing the covered elastic yarn of the present invention, a covering machine may be used, or an elastic fiber and a non-elastic fiber (the polyethylene fiber of the present invention) may be assembled and twisted while the elastic fiber is being drafted. A rate at which the elastic fiber is mixed is greater than or equal to 1 mass %, is preferably greater than or equal to 5 mass %, and is more preferably greater than or equal to 10 mass %. When the rate at which the elastic fiber is mixed is low, a sufficient recovery from elongation and contraction cannot be obtained. However, when the rate is excessively high, a strength is reduced. Therefore, the rate is preferably not greater than 50 mass %, and is more preferably not greater than 30 mass %.

A woven product or a knitted product (woven/knitted textile) which contains the polyethylene fiber of the present invention and/or the covered elastic yarn of the present invention, is favorably used as protective woven/knitted textiles. The protective woven/knitted textile of the present invention preferably indicates an index value of a coup tester which is greater than or equal to 3.9 in light of cut-resistance and durability. Further, although an upper limit of the index value of the coup tester is not defined, the fiber may be thickened in order to increase the index value of the coup tester. However, in this case, texture characteristics tend to be deteriorated. Therefore, in light thereof, the upper limit of the index value of the coup tester is preferably 14. Further, the range of the index values of the coup tester is set such that the index value of the coup tester is more preferably greater than or equal to 5, and is more preferably not greater than 12, and the index value of the coup tester is even more preferably greater than or equal to 6, and is even more preferably not greater than 10.

Further, it is assumed that the porous structure of the polyethylene fiber of the present invention exerts a great influence on results of evaluations of cut-resistance using the coup tester. Namely, it is assumed that the pores act as cushions, and energy is dispersed and/or absorbed in portions with which a blade of the coup tester contacts and in structures around the portions.

In the woven/knitted textile of the present invention, a proportion of the covered elastic yarns of the present invention as described above, in the yarns constitutes the woven/knitted textile, is preferably greater than or equal to 30 mass %. Further, in the covered elastic yarn, a fineness per one filament is preferably greater than or equal to 1.5 dtex, and is preferably not greater than 220 dtex. Synthetic fibers such as polyester fibers, nylon fibers, and acrylic fibers, natural fibers such as cotton and wool, regenerated fibers such as rayon fibers, and/or the like may be contained such that a proportion of these other fibers is less than or equal to 70 mass % in the yarns constitutes the woven/knitted textile. In order to ensure abrasion-durability, polyester multifilaments or nylon filaments in which a fineness per one filament ranges from 1 dtex to 4 dtex can be preferably used. When these constituents are employed in addition to use of the polyethylene fiber and/or the covered elastic yarns of the present invention, an index value of a coup tester for the woven/knitted textile can be within the range described above.

A protective woven/knitted textile containing the fiber and/or the covered elastic yarns according to the present invention can be favorably used as materials of cut-resistant gloves. The glove of the present invention can be knitted by a knitting machine with the use of the fiber and/or the covered elastic yarns of the present invention. Alternatively, the fiber and/or the covered elastic yarns of the present invention may be woven by a weaving machine into a fabric, and the glove may be sewn by the fabric being cut and joined.

A base cloth of the cut-resistant glove of the present invention contains the covered elastic yarns of the present invention as described above as a fiber component. In light of the cut-resistance, a proportion of the covered elastic yarns in the base cloth is preferably greater than or equal to 30 mass %, is more preferably greater than or equal to 50 mass %, and is even more preferably greater than or equal to 70 mass %. A fineness per one filament of the covered elastic yarn is preferably greater than or equal to 1.5 dtex, and is preferably not greater than 220 dtex. The fineness per one filament is more preferably greater than or equal to 10 dtex, and is more preferably not greater than 165 dtex. The fineness per one filament is even more preferably greater than or equal to 20 dtex, and is even more preferably not greater than 110 dtex.

Synthetic fibers such as polyester fibers, nylon fibers, and acrylic fibers, natural fibers such as cotton and wool, regenerated fibers such as rayon fibers, and/or the like may be contained such that a proportion of these other fiber components is less than or equal to 70% by mass in the base cloth. In order to ensure abrasion-durability, polyester multifilaments or nylon filaments in which a fineness per one filament ranges from 1 dtex to 4 dtex are preferably used.

The glove having been thus obtained can be used as a glove as it is. However, a resin can be applied thereto in order to provide a non-slip characteristic as necessary. Examples of the resin used herein include, but are not limited to, urethane resins and ethylene resins.

EXAMPLES

Hereinafter, the present invention will be specifically described by means of examples. However, the present invention is not limited to examples described below. In examples, characteristic values of the polyethylene fiber, a knitted fabric using the same, and a dyed product thereof were measured and evaluated as follows.

(1) Intrinsic Viscosity

Decalin at 135° C. was used to obtain diluted solutions having various concentrations, and specific viscosities of the diluted solutions having various concentrations were measured by using an Ubbelohde capillary viscometer. An intrinsic viscosity [dl/g] was determined based on extrapolated points to an originating point of a straight line obtained by least squares approximation of viscosities plotted against the concentrations. When the measurement was performed, a sample was divided or cut into portions each having a length of about 5 mm, and 1 mass % of an antioxidant (trade name "YOSHINOX (registered trademark) BHT", manufactured by Yoshitomi Pharmaceutical Co., Ltd.) relative to a polymer was added, and stirred and dissolved at 135° C. for four hours, to prepare measurement solutions having various concentrations.

(2) Weight Average Molecular Weight Mw, Number Average Molecular Weight Mn, and Mw/Mn The weight average molecular weight Mw, the number average molecular weight Mn, and the Mw/Mn were measured by the gel permeation chromatography (GPC). As a GPC instrument, GPC, 150C ALC/GPC manufactured by Waters was used; as columns, one GPC UT802.5 column and two GPC UT806M columns, both manufactured by SHODEX, were used; and a differential refractometer (RI detector) was used as a detector; to perform measurement. As a measurement solvent, o-dichlorobenzene was used and a column temperature was set to 145° C. A concentration of a sample was adjusted to 1.0 mg/ml, and 200 μL of the sample solution was injected, to perform measurement. A molecular weight calibration curve was obtained, by a universal calibration method, by using a sample of a polystyrene the molecular weight of which was known.

(3) Tensile Strength, Rate of Elongation and Modulus

A tensile strength, rate of elongation and a modulus were calculated as follows. That is, stress-strain curve was obtained, under the condition that a length of a sample was 200 mm ( ) and an elongation rate was 100%/min., an atmospheric temperature was 20° C., and a relative humidity was 65%; by using "TENSILON Universal Material Testing Instrument" manufactured by ORIENTEC Co., LTD., and a stress and an elongation at the breaking point on the curve obtained were measured as a tensile strength (cN/dtex) and a rate of elongation (%) respectively, and a modulus (cN/dtex) was calculated from the tangent line providing a maximum gradient on the curve in the vicinity of the originating point. The measurement was conducted ten times, and an average of values obtained in the ten measurements was used for each of the tensile strength and the modulus.

(4) Pore Average Diameter and Porosity

Preprocessing was performed such that a sample was subjected to vacuum-deaeration at room temperature for 24 hours. Next, 0.08 g of the sample was put into a vessel having a cell volumetric capacity of 6 mL, and a distribution of pores having pore radiuses ranging from about 0.0018 μm to 100 μm was measured by using the AutoPore (registered trademark) III 9420 (manufactured by Micromeritics). A value obtained by differentiating a mercury permeating volume per 1 g of the sample with respect to the diameter of each pore is able to be obtained by this measurement. At this time, the pore was approximated by a column, a contact angle was 140 degrees, and a density of mercury was 13.5335 g/mL.

The porosity was calculated by using the following equation.

Porosity (%)=100×(volumetric capacity [mL] of pores having diameters ranging from 3 nm to 1 μm×sample mass [g])/(cell volumetric capacity−(mercury mass [g]/mercury density [g/mL]))

(5) The Number of Pores on Cross-Section of Fiber

A sample of the cross-section of the fiber was prepared by the following procedure.

The sample embedded in an acrylic resin ("SAMPLKWICK (registered trademark) 473", manufactured by BUEHLER) was vertically cut in a direction orthogonal to the fiber axis at an acceleration voltage of 5 kV by using a cross section polisher (registered trademark) manufactured by JEOL Ltd.

The cross section of the sample was observed at an acceleration voltage of 0.5 kV by using a scanning electron microscope ("S4800", manufactured by Hitachi High-Technologies Corporation), and a photograph thereof was taken at 20,000× magnification. Subsequently, the pores that were in any 30 $\mu m^2$ cross-section of the fiber and that had diameters ranging from 3 nm to 1 μm were visually counted, to calculate the number of pores per 1 $\mu m^2$. This measurement was performed five times at different portions, and an average value was used. When the pore was not circular, a maximal dimension was used as the diameter of the pore.

(6) Thermal Conductivity at 300K

A thermal conductivity was measured, by using a system including a temperature control device with a helium refrigerator, in a steady-state heat flow method. A length of a sample was about 25 mm, and a fiber bundle was obtained by about 5000 monofilaments being aligned and collected into a bundle. The ends of the fiber were fixed by using "STYCAST GT" (an adhesive manufactured by Grace Japan Ltd.), to set the fiber on a sample base.

For measuring temperatures, an Au-chromel thermocouple was used. As a heater, 1 kΩ resistance was used and the heater was adhered to an end of the fiber bundle by using a varnish. The two levels of measurement temperatures, i.e., 300K and 100K, were used. The measurement was conducted in a vacuum state of $10^{-5}$ torr ($1.33\times10^{-5}$ kPa) in order to maintain thermal insulation. The measurement was started after the vacuum state of $10^{-5}$ torr at 30° C. had been maintained for 24 hours, in order to dry the sample.

When a cross-sectional area of the fiber bundle is represented as S, a distance of the thermocouple is represented as L, an amount of heat applied by the heater is represented as Q, and a difference in temperature generated in the thermocouple is represented as ΔT, a thermal conductivity G is calculated by the following equation.

$$G(\text{mW/cmK})=(Q/\Delta T)\times(L/S)$$

The measurement was carried out according to the method described in detail in the following documents.

H. Fujishiro, M. Ikebe, T. Kashima. A. Yamanaka, Jpn. J. Appl. Phys., 36, 5633 (1997)

H. Fujishiro, M. Ikebe, T. Kashima. A. Yamanaka, Jpn. J. Appl. Phys., 37, 1994 (1998)

(7) Quantitative Measurement of Organic Substance Having High Affinity for Disperse Dye and Polyethylene Firstly, the organic substance was identified by using, for example, a gas chromatography-mass spectrometer or a $^1$H-NMR measurement. Next, the organic substance was quantitatively measured by the following method.

The sample was immersed in acetone/hexane (=5/5) mixture at room temperature for 2 minutes, and washed. The washing treatment was repeated three times, and thereafter about 10 mg of the sample was mixed with 0.6 mL of ortho-dichlorobenzene/$C_6D_6$ (=8/2), and dissolved at 135° C. Next, the $^1$H-NMR (spectrometer; Bruker BioSpin AVANCE 500, magnet; manufactured by Oxford Instruments) was used to carry out measurement.

The measurement condition was set such that $^1$H resonance frequency: 500.1 MHz, a flip angle of detection pulse: 45 degrees, a data sampling interval: 4.0 seconds, delay time: 1.0 second, the cumulative number of times: 64 times, and measurement temperature: 110° C. were satisfied. The TOPSPIN (registered trademark) ver. 2.1 manufactured by Bruker BioSpin K. K. was used as a measurement and analysis program. Further, the sample was dissolved in heavy water, or a dried residue was dissolved in $CDCl_3$, and the $^1$H-NMR measurement was made to perform quantitative evaluation of the organic substance. The calculation method was used in which a value of integral of a peak based on 0.8 to 1.5 ppm of the polyethylene was represented as A, and a value of integral of a peak based on the organic substance which has been previously calculated, was represented as B, and a proportion (X mass %) of the organic substance was calculated by using B/A (molar ratio).

The value of B/A (molar ratio) was converted by using a monomer-based molecular weight ratio, to calculate the proportion (X mass %) of the organic substance. For example, when the organic substance was a polypropylene glycol/polyethylene glycol (=90/10; mass ratio, monomer-based molecular weight ratio; 1.95) mixture, the proportion of the organic substance was calculated by using the following equation.

$$X=(B/A)\times1.95$$

(8) Exhaustion Rate

A sample having a weight of 1 g was put into a refining liquid (an amount of the liquid is 50 times the amount of the sample, 2 g/L of NOIGEN (registered trademark) HC) at 70° C., and was refined for 20 minutes. Next, the sample was washed with water, dewatered, and dried.

A disperse dye (Diaceliton fast Scarlet B (CI Disperse Red1)) and a dyeing aid (Disper TL) were dissolved in ion-exchanged water at such a concentration that 0.4000 g of the disperse dye was included in 1 L of the ion-exchanged water, and 1 g of the dyeing aid was included in 1 L of the ion-exchanged water, to obtain a dye liquor. Into a conical flask, 100 mL of the dye liquor and 1 g of the refined sample were put, and the dye liquor was shaken for 90 minutes while being heated in an oil bath set to 115° C. The number of times the shaking was performed was 110 times per minute.

Thereafter, the temperature of the residual liquid of the dye liquor was cooled down to room temperature, 5 mL of the residual liquid and 5 mL of acetone were put into a measuring flask and mixed, and acetone/water (1/1) was further added thereto so as to obtain the total amount of 100 ml (a). Similarly, 5 ml of the dye liquor which had not been used for dyeing, and 5 mL of acetone were put into a measuring flask and mixed, and acetone/water (1/1) was further added thereto so as to obtain the total amount of 100 ml (b).

Next, absorbances of the residual liquid (a) and the unused dye liquor (b) for a wavelength ranging from 350 nm to 700 nm were measured by using an ultraviolet spectrophotometer (Type 150-20 (double beam spectrophotometer)) manufactured by Hitachi, Ltd., and the maximal values thereof were used as an absorbance a of the residual liquid and an absorbance b of the unused dye liquor, respectively. An exhaustion rate (DY %) was calculated by using the obtained absorbances according to the following equation.

$$DY(\%)=(1-(\text{absorbance } a \text{ of the residual liquid})/(\text{absorbance } b \text{ of the unused dye liquor}))\times100$$

(9) Cut Resistance Measurement

As an evaluation method, a method using a coup tester (cut tester manufactured by SODMAT) was used. An aluminum foil was provided on a sample stage of the tester, and a sample was put on the aluminum foil. Next, a circular blade provided on the tester was caused to travel on the sample while the circular blade was being simultaneously rotated in a direction opposite to the traveling direction. When the sample had been cut, the circular blade and the aluminum foil contacted each other, so that an electric current flows, and it was determined that the cut resistance test had been ended. While the circular blade was operating, a counter mounted to the tester counts numerical values in accordance with the number of revolutions of the circular blade, and the numerical values were recorded.

In the test, a plain-woven cotton fabric having a weight per unit area of about 200 g/m$^2$ was used as a blank, and a cut level of the test sample (gloves) was evaluated. The test was started with the blank, and the test of the blank and the test of the test sample were alternately performed, and the test sample was tested five times, and the test was ended with the sixth test of the blank, thereby completing one set of tests. Five sets of the tests were performed, and an average Index value obtained from the five sets of the tests was employed as a substitute evaluation value for the cut resistance. It is considered that the higher the Index value is, the more excellent the cut resistance is.

The evaluation value obtained as described above was referred to as an Index, and the Index was calculated by using the following equation.

$A$=(a counted value for the cotton fabric obtained before the sample test+a counted value for the cotton fabric obtained after the sample test)/2

Index=(a counted value for the sample+$A$)/$A$

A cutter used for this evaluation was an L-type rotary cutter, manufactured by OLFA CORPORATION, having ϕ45 mm. The material thereof was an SKS-7 tungsten steel, and a thickness of the blade was 0.3 mm. An applied load in the test was 3.14 N (320 gf). Thus, an evaluation was carried made.

(10) Specific Gravity

A specific gravity of the fiber was measured by using a density gradient tube method.

(Production of Density Gradient Tube)

Water was used as a heavy liquid, and isopropyl alcohol was used as a light liquid. While the light liquid continued to be gradually mixed with the heavy liquid, they were poured into a glass tube having scale marks. The heavy liquid was in the bottom portion of the glass tube, and a proportion of the light liquid was increased toward the upper portion of the glass tube. Thus, a density gradient tube was prepared. Next, the density gradient tube was put into a constant temperature bath having a temperature of 30° C.±0.1° C.

Next, five or more glass balls (having specific gravities different from each other) of which the specific gravities were known were carefully put into the density gradient tube having been prepared, and they were left stationary as they were for one day. Thereafter, a distance between each glass ball and the liquid level was measured, and a graph (a calibration curve) in which the obtained distances were represented by the vertical axis, and values of the specific gravities of the glass balls were represented by the horizontal axis, was made. The graph represented a straight line, and it was confirmed that a correct specific gravity solution was obtained.

(Measurement of Specific Gravity)

Fiber samples (the lengths of the samples: 6 mm to 8 mm) were put into the density gradient tube having been prepared as described above. Positions of each fiber sample from the liquid level were measured immediately after, five hours after, and 24 hours after the fiber sample was put into the density gradient tube. A value of the specific gravity at the position of each sample was obtained by using the calibration curve having been made when the density gradient tube was prepared.

Further, it was determined that a fiber sample of which the specific gravity value measured 24 hours later was greater than the specific gravity value measured five hours later, had, inside the fiber, pores communicating with the surface of the fiber.

Example 1

A container having a nitrogen atmosphere of 0.002 MPa was filled with chips of a high-density polyethylene in which an intrinsic viscosity was 1.6 dL/g, a weight average molecular weight was 100,000, and a ratio of the weight average molecular weight to a number average molecular weight was 2.3. The chips of the high-density polyethylene were melted at 260° C., and were then supplied to a spinning chimney, and the melted resin was filtrated through a nozzle filter (diameter for mesh was 5 μm) provided in the spinning chimney, and was then discharged from a spinneret having 30 holes each having an orifice diameter of ϕ0.8 mm at a nozzle (spinneret) surface temperature of 290° C. at a single hole throughput of 0.5 g/min. Discharged filaments were caused to pass through a heat-retaining section (120° C.) which was 15 cm long, were then quenched in a cooling section which was 1 m long and set to 40° C., at 0.4 m/s, and were wound into a cheese at a spinning speed of 300 m/min., thereby obtaining non-drawn filaments.

Before the filaments were wound into a cheese, octapolyether/ethylene glycol (=80/20; mass ratio) mixture was applied to the non-drawn filaments such that a dry mass thereof was 2 mass %. Thereafter, the non-drawn filaments having been wound into the cheese were left stationary as they were for one day. Next, by using a drawing machine in which a distance between rollers was 50 cm, and a roller temperature and an ambient temperature were each set to 65° C., the non-drawn filaments having the organic substance applied thereto were drawn 2.8-fold in one action between two driving rollers, at a deformation speed of 0.11 msec. (the first drawing step). Further, the obtained filaments were heated by using hot air at 105° C., and were drawn 5.0-fold (the second drawing step). Properties of the obtained fiber filaments, a content of the organic substance, and an evaluation result are indicated in table 1.

12 fiber filaments (37 dtex) having been obtained were aligned and collected to be used as a sheath yarn of 440 dtex, and a 155 dtex spandex ("Espa (registered trademark)" manufactured by TOYOBO CO., LTD.) was used as a core yarn, to obtain a single covering yarn. The obtained single covering yarns were used to knit a glove having a weight per unit area of 500 g/m$^2$, by using a glove knitting machine manufactured by SHIMA SEIKI MFG, LTD.

The index value of the coup tester for the obtained glove is indicated in Table 1. The obtained glove was also excellent in ease of putting-on and taking-off.

Example 2

Fiber filaments were obtained in the same manner as that for Example 1 except that a nitrogen gas pressure in the container was 0.15 MPa, the diameter for the mesh of the nozzle filter was 20 μm, 3 mass % of a polypropylene glycol was applied to the non-drawn filaments as the organic substance, a distance between rollers was 200 cm, the roller temperature and the ambient temperature of the drawing machine were each set to 50° C., and 3.0-fold drawing was performed between two driving rollers (the deformation speed: 0.15 m/sec. to 0.35 m/sec., the first drawing step), and the condition for the subsequent drawing using hot air was set such that the temperature of the hot air was 107° C., and a draw ratio was 4.0 (the second drawing step). Properties of the obtained fiber filaments, a content of the organic substance, and an evaluation result are indicated in table 1.

Further, as in Example 1, a single covering yarn was obtained by using the obtained fiber filaments, to obtain a glove. The index value of the coup tester for the obtained glove is indicated in Table 1.

Example 3

Fiber filaments were obtained in the same manner as that for Example 1 except that a high-density polyethylene having an intrinsic viscosity was 1.7 dL/g, a weight average molecular weight of 115,000, and a ratio of the weight average molecular weight to a number average molecular weight of 2.3 was employed, a nitrogen gas pressure in the container was 0.15 MPa, 2 mass % of polyethyleneglycol/paraffin (=88/12; mass ration) mixture was applied to the non-drawn filaments as the organic substance, a distance between rollers was 100 cm, the roller temperature and the ambient temperature of the drawing machine were each set to 20° C., and 2.0-fold drawing was performed between two driving rollers (the deformation speed: 0.08 m/sec. to 0.30 m/sec., the first drawing step), and the condition for the subsequent drawing using hot air was set such that the temperature of the hot air was 105° C., and a draw ratio was 6.0 (the second drawing step). Properties of the obtained fiber filaments, a content of the organic substance, and an evaluation result are indicated in table 1.

Further, as in Example 1, a single covering yarn was obtained by using the obtained fiber filaments, to obtain a glove. The index value of the coup tester for the obtained glove is indicated in Table 1.

Example 4

Fiber filaments were obtained in the same manner as that for Example 1 except that a high-density polyethylene having an intrinsic viscosity was 1.7 dL/g, a weight average molecular weight of 115,000, and a ratio of the weight average molecular weight to a number average molecular weight of 2.3 was employed, a nitrogen gas pressure in the container was 0.1 MPa, the diameter for the mesh of the nozzle filter was 15 μm, a distance between rollers was 100 cm, the roller temperature and the ambient temperature of the drawing machine were each set to 65° C., and 2.0-fold drawing was performed between two driving rollers (the deformation speed: 0.08 msec. to 0.30 m/sec., the first drawing step), and the condition for the subsequent drawing using hot air was set such that the temperature of the hot air was 103° C., and a draw ratio was 5.5 (the second drawing step). Properties of the obtained fiber filaments, a content of the organic substance, and an evaluation result are indicated in table 1.

Further, as in Example 1, a single covering yarn was obtained by using the obtained fiber filaments, to obtain a glove. The index value of the coup tester for the obtained glove is indicated in Table 1.

Example 5

Fiber filaments were obtained in the same manner as that for Example 1 except that a high-density polyethylene having an intrinsic viscosity was 1.7 dL/g, a weight average molecular weight of 115,000, and a ratio of the weight average molecular weight to a number average molecular weight of 2.3 was employed, a nitrogen gas pressure in the container was 0.1 MPa, the diameter for the mesh of the nozzle filter was 15 μm, 2 mass % of polyoxybutylene (molecular weight: 12,000)/ethylene glycol (=80/20; mass ration) mixture was applied to the non-drawn filaments as the organic substance, a distance between rollers was 100 cm, the roller temperature and the ambient temperature of the drawing machine were each set to 65° C., and 2.0-fold drawing was performed between two driving rollers (the first drawing step), and the condition for the subsequent drawing using hot air was set such that a draw ratio was 6.0 (the second drawing step). Properties of the obtained fiber filaments, a content of the organic substance, and an evaluation result are indicated in table 1.

Further, as in Example 1, a single covering yarn was obtained by using the obtained fiber filaments, to obtain a glove. The index value of the coup tester for the obtained glove is indicated in Table 1.

Comparative Example 1

A slurry mixture of 90 mass % of a decahydronaphthalene, and 10 mass % of an ultrahigh molecular weight polyethylene having an intrinsic viscosity of 20 dL/g, a weight average molecular weight of 3,300,000, and a ratio of the weight average molecular weight to a number average molecular weight of 6.3, was melted by a screw-type kneader which was set to a temperature of 230° C. while being dispersed, and the melted mixture was supplied to a spinneret (nozzle) that had a nozzle filter in which the diameter for a mesh was 200 μm, that had 2000 openings each having a diameter of 0.2 mm, and that was set to 170° C., by a metering pump, so as to obtain a single hole throughput of 0.08 g/min.

Nitrogen gas that was adjusted to 100° C. was supplied at a speed of 1.2 m/min. by using a slit-shaped gas supply orifice mounted vertically below the nozzle, so as to apply the nitrogen gas to filaments as uniformly as possible, thereby actively evaporating the decalin on the surfaces of the fiber filaments. Thereafter, the filaments were substantially cooled by air flow set to 30° C., and taken up at a speed of 50 m/min. by a Nelson roller provided downstream of the nozzle. At this time, a solvent contained in the filaments was reduced such that the mass of the solvent was about half of the mass of the originally contained solvent.

Subsequent thereto, the fiber filaments were drawn 3-fold in an oven having been heated to 120° C. (deformation speed: 0.008 m/sec. to 0.021 m/sec.). At this time, for the fiber filaments, 0.5 mass % of octapolyether/ethylene glycol (=80/20; mass ratio) mixture was applied to the non-drawn filaments. Subsequently, the fiber filaments were drawn 4.6-fold in an oven having been heated to 149° C. Properties of the obtained fiber filaments, a content of the organic substance, and an evaluation result are indicated in table 1. Further, in the method of (7) described above, it was confirmed that the organic substance (octapolyether and ethylene glycol) was not left contained in the fiber filaments.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 2

A slurry mixture prepared as in Comparative example 1 was melted by a screw-type kneader which was set to a temperature of 230° C., and was supplied to a spinneret (nozzle) that had 500 openings each having a diameter of 0.8 mm, and was set to 180° C., by a metering pump, so as to obtain a single hole throughput of 1.6 g/min. Nitrogen gas that was adjusted to 100° C. was supplied at a speed of 1.2 m/min. by using a slit-shaped gas supply orifice mounted vertically below the nozzle, so as to apply the nitrogen gas to filaments as uniformly as possible, thereby actively evaporating decalin on the surfaces of the fiber filaments. Thereafter, the filaments were taken up at a speed of 100 m/min. by a Nelson roller provided downstream of the nozzle. At this time, a solvent contained in the filaments was reduced such that the mass of the solvent was about 60% of the mass of the originally contained solvent. Subsequent thereto, water was applied to the filaments at a water application rate of 3 mass %, and the fiber filaments were drawn 4.0-fold in an oven having been heated to 130° C. (deformation speed: 0.008 msec. to 0.021 m/sec.). Subsequently, the fiber filaments were drawn 3.5-fold in an oven having been heated to 149° C. Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 3

A high-density polyethylene having an intrinsic viscosity of 1.7 dL/g, a weight average molecular weight of 115,000, a ratio of the weight average molecular weight to a number average molecular weight of 2.3, and the number of branched chains each having such a length as to contain at least five carbon atoms was 0.4 per 1000 carbon atoms, was extruded at 290° C. at a single hole throughput of 0.5 g/min. from a spinneret (nozzle) having a filter in which the diameter for a mesh was 200 μm, an orifice diameter of ϕ0.8 mm, and 30 holes. The extruded fiber filaments were caused to pass through a heat-retaining section which was 15 cm long, were then quenched at 20° C. at 0.5 m/s, and were wound at a speed of 300 m/min., to obtain non-drawn filaments. Water was applied to the non-drawn filaments at a water application rate of 3 mass %, and the filaments were drawn by using a plurality of Nelson rollers of which the temperatures were able to be controlled. In the first drawing step, 2.8-fold drawing was performed at 25° C. (deformation speed: 0.01 msec. to 0.07 m/sec.). Further, the obtained filaments were heated up to 115° C., and then 5.0-fold drawing was performed (the second drawing step). Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 4

Non-drawn fiber filaments were obtained in the same condition as that for comparative example 3 except that a drawing temperature at the first drawing step was 90° C. and a deformation speed was 0.01 msec to 0.07 msec. Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 5

Non-drawn fiber filaments were obtained in the same manner as that for comparative example 3 except that a high-density polyethylene having an intrinsic viscosity of 1.9 dL/g, a weight average molecular weight of 121,500, a ratio of the weight average molecular weight to a number average molecular weight of 5.1, and the number of branched chains each having such a length as to contain at least five carbon atoms was 0.4 per 1000 carbon atoms, was extruded at 270° C. at a single hole throughput of 0.5 g/min. from a spinneret (nozzle) having an orifice diameter of ϕ0.8 mm, and 30 holes. Water was applied to the non-drawn filaments at a water application rate of 3 mass %, and 2.8-fold drawing was performed at 90° C. (deformation speed: 0.01 m/sec. to 0.07 m/sec., the first drawing step). Subsequently, the obtained fiber filaments were heated up to 115° C., and then 3.8-fold drawing was performed (the second drawing step) to obtain the fiber filaments. At a draw ratio greater than 3.8, breakage of filaments occurred during the drawing. Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 6

Non-drawn fiber filaments were obtained in the same manner as that for example 1 except that a high-density polyethylene having an intrinsic viscosity of 1.1 dL/g, a weight average molecular weight of 52,000, a ratio of the weight average molecular weight to a number average molecular weight of 8.2, and the number of branched chains each having such a length as to contain at least five carbon atoms was 0.6 per 1000 carbon atoms, was extruded at 255° C. at a single hole throughput of 0.5 g/min. from a spinneret (nozzle) having an orifice diameter of ϕ0.8 mm, and 30 holes. Water was applied to the non-drawn filaments at a water application rate of 3 mass %, and 1.1-fold drawing was performed at 40° C. (deformation speed: 0.012 m/sec. to 0.032 m/sec., the first drawing step). Subsequently, the obtained fiber filaments were heated up to 100° C., and then 5.0-fold drawing was performed (the second drawing step) to obtain the fiber filaments. At a draw ratio greater than 5.0, breakage of filaments occurred during the drawing. Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

It was confirmed that a strength and a cut-resistance of the fiber were very low.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 7

A high-density polyethylene having an intrinsic viscosity of 1.8 dL/g, a weight average molecular weight of 115,000, and a ratio of the weight average molecular weight to a number average molecular weight of 2.2, was extruded at 290° C. at a single hole throughput of 0.5 g/min. from a spinneret (nozzle) having an orifice diameter of ϕ0.8 mm, and 30 holes. The extruded fiber filaments were caused to pass through a heat-retaining cylinder which was 15 cm long and was heated to 110° C., then quenched in a water bath in which the temperature was maintained at 20° C., and wound at a speed of 300 m/min. Water was applied to the non-drawn filaments at a water application rate of 3 mass %, the non-drawn filaments were heated to 100° C., fed at 10 m/min., and gradually drawn by using eight driving rollers which were each distanced from an adjacent roller by 800 cm, so as to equalize the draw ratio between each roller, such that the total draw ratio was 2 (deformation speed: 0.012 msec. to 0.032 m/sec., the first drawing step). Thereafter, the filaments were heated to 115° C., and the second drawing step was performed at a draw ratio of 7.0, to obtain drawn filaments. Properties of the obtained fiber filaments, and an evaluation result are indicated in table 1.

Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Comparative Example 8

A high-density polyethylene having an intrinsic viscosity of 1.8 dL/g, a weight average molecular weight of 115,000, a ratio of the weight average molecular weight to a number average molecular weight of 2.3, and the number of branched chains each having such a length as to contain at least five carbon atoms was 0.4 per 1000 carbon atoms, was extruded at 290° C. at a single hole throughput of 0.5 g/min. from a spinneret (nozzle) having an orifice diameter of ϕ0.8 mm, and 30 holes. The extruded fiber filaments were caused to pass through a heat-retaining section which was 15 cm long, and then quenched at 20° C. at 0.5 m/s, and were wound at a speed of 300 m/min. Water was applied to the obtained non-drawn filaments at a water application rate of 3 mass %, and the filaments were gradually drawn by using a plurality of Nelson rollers of which the temperatures were able to be controlled and which were each distanced from an adjacent roller by 1000 cm. In the first drawing step, 2.8-fold drawing was performed at 25° C. (deformation speed: 0.012 msec. to 0.032 m/sec.). Further, the obtained filaments were heated up to 115° C., and then 5.0-fold drawing was performed as the second drawing step to obtain drawn filaments. Properties of the obtained fiber filaments, and an evaluation result are indicated in table 1. Further, as in Example 1, a single covering yarn was obtained by using the obtained fiber filaments, to obtain a glove. The index value of the coup tester for the obtained glove is indicated in Table 1.

Furthermore, as in Example 1, production of a dyed knitted textile with the use of the obtained fiber filaments was attempted. However, since the dyeing was not able to be performed sufficiently for conducting a test for the fastness, the color fastness test was canceled.

Example 6

Filaments of the highly-functional polyethylene fibers obtained in examples 1 to 6 were soft-wound into cheeses (2 kg/one cheese), the filaments were dyed in the dyeing method described below in (11), dyed knitted fabric was obtained, and color fastness thereof was evaluated (example 6-1 to example 6-5). The knitted fabric for the evaluation was plain-stitch fabric that had a density satisfying C/W=19/30, and that was obtained by using a knitting machine of a single knit type in which a cylinder diameter was ϕ30 inch, and the gauge was 18 (the number of needles in 1 inch).

(11) Dyeing Method

A condition for refinement was set such that 1 g/L of "NOIGEN (registered trademark) HC (manufactured by Dai-ichi Kogyo Seiyaku Co., Ltd.)" was used, a fiber filament was refined in the liquor at 60° C. at a bath ratio of 1:30 with stirring for ten minutes, and washing with hot water at 60° C., dewatering, and air-drying were performed.

The dyeing was carried out in the following method.

(i) Used Dye

"Dianix (registered trademark) Black GS-E" manufactured by DyStar Japan Ltd. was used as a black dye, and "Sumikaron (registered trademark) Blue S-BG 200%" manufactured by Sumitomo Chemical Company, Limited was used as a blue dye.

(ii) Condition for Dyeing

For black color, the black dye was dispersed in water to prepare a dye liquor such that a concentration of the black dye was 6% owf, and a bath ratio was 1:10. For blue color, the blue dye was dispersed in water to prepare a dye liquor such that a concentration of the blue dye was 2% owf, and a bath ratio was 1:10. Subsequently, the knitted fabrics for evaluation were immersed in the dye liquors, and the temperature was increased at a rate of 2° C./min., and maintained at 100° C. for 30 minutes, and then cooled to normal temperature by water-cooling, and the fabrics were washed with hot water at 60° C., and repeatedly washed and drained until discharged water remained uncolored.

(iii) Reduction Cleaning

In order to wash away excess dye attached to the knitted fabrics for evaluation, the knitted fabrics were subjected to reduction-cleaning in a mixture of 0.8 g/L of "Tec Light" manufactured by ADEKA, and 0.5 g/L of sodium hydroxide, at 80° C., for 10 minutes. The knitted fabrics were then washed with hot water at 60° C., then dewatered, and air-dried.

Dyed knitted fabrics that were obtained from the highly functional polyethylene fiber, and that were dyed in two colors were evaluated for fastness to washing and fastness to dry-cleaning in the following method. The evaluation results are indicated in table 2.

(12) Fastness Evaluation Method (i) Fastness to Washing

Evaluation was made in compliance with JIS L-0844 A-1 (laundry contamination). At this time, hang-drying was performed.

(ii) Fastness to Rubbing

A drying test and a wetting test were performed by using a friction test machine Type II in compliance with JIS L-0849.

(iii) Fastness to Perspiration

A test was performed by using an artificial acidic perspiration solution and an artificial alkaline perspiration solution in compliance with JIS-L-0848.

(iv) Fastness to Dry Cleaning

Evaluation was made by using perchloroethylene in compliance with JIS L-0860 Method A-1. Further, evaluation on laundry contamination was made by using petroleum substance in compliance with JIS L-0860 Method B-1.

All of the obtained results indicated grade 4 to grade 5, which were excellent. Further, fastness to light (JIS L 0842) favorably indicated grade 3 or higher grade.

TABLE 1-1

| | | unit | Example 1 | Example 2 | Example 3 | Example 4 | Example 5 |
|---|---|---|---|---|---|---|---|
| Spinning condition | Mesh diameter of nozzle filter | μm | 5 | 20 | 5 | 15 | 15 |
| | Innert gas pressure | MPa | 0.002 | 0.15 | 0.15 | 0.1 | 0.1 |
| | Single hole throughput | g/min | 0.5 | 0.5 | 0.5 | 0.5 | 0.5 |
| 1st drawing step condition | Drawing temperature | ?C | 65 | 50 | 20 | 65 | 65 |
| | Drawing ratio | — | 2.8 | 3.0 | 2.0 | 2.0 | 2.0 |
| 2nd drawing step condition | Drawing temperatue | ?C | 105 | 107 | 105 | 103 | 105 |
| | Drawing ratio | — | 5.0 | 4.0 | 6.0 | 5.5 | 6.0 |
| Raw resin property | Intrinsic viscosity | dL/g | 1.6 | 1.6 | 1.7 | 1.7 | 1.7 |
| | Specific gravity | g/cm$^3$ | 0.955 | 0.955 | 0.956 | 0.956 | 0.956 |
| Fiber property | Mw (fiber) | — | 100,000 | 100,000 | 115,000 | 115,000 | 115,000 |
| | Mw/Mn (fiber) | — | 2.3 | 2.3 | 2.3 | 2.3 | 2.3 |
| | Tensile strength | cN/dtex | 14.8 | 13.9 | 15.2 | 12.1 | 14.5 |
| | Modulus | cN/dtex | 549 | 480 | 625 | 410 | 475 |
| | Number of pores per unit of cross-sectional area | pore/μm$^2$ | 17 | 8 | 15 | 0.3 | 11 |
| | Pore average diameter | nm | 44 | 130 | 30 | 25 | 30 |
| | Porosity | % | 2.8 | 9.4 | 4.1 | 2.4 | 3.1 |
| | Exhaustion rate | % | 31 | 45 | 45 | 20 | 35 |
| | Thermal conductivity | W/mK | 15 | 7 | 35 | 28 | 30 |
| | Organic substance content in fiber | mass % | 0.5 | 0.8 | 0.5 | 0.4 | 0.3 |
| | Specific gravity, 5 hours later | | 0.905 | 0.895 | 0.903 | 0.894 | 0.901 |
| | Specific gravity, 24 hours later | | 0.915 | 0.915 | 0.925 | 0.920 | 0.922 |
| Evaluation of Gloves | Cut resistance Index value | — | 4.3 | 4.1 | 4.3 | 5.2 | 4.5 |

TABLE 1-2

| | | unit | Comparative Example 1 | Comparative Example 2 | Comparative Example 3 | Comparative Example 4 |
|---|---|---|---|---|---|---|
| Spinning condition | Mesh diameter of nozzle filter | μm | 200 | 200 | 200 | 200 |
| | Innert gas pressure | MPa | — | — | 0.05 | 0.05 |
| | Single hole throughput | g/min | 0.08 | 1.6 | 0.5 | 0.5 |
| 1st drawing step condition | Drawing temperature | ?C | 120 | 130 | 25 | 90 |
| | Drawing ratio | — | 3.0 | 4.0 | 2.8 | 2.8 |
| 2nd drawing step condition | Drawing temperatue | ?C | 149 | 149 | 115 | 115 |
| | Drawing ratio | — | 4.6 | 3.5 | 5.0 | 5.0 |
| Raw resin property | Limiting viscosity | dL/g | 20 | 20 | 1.7 | 1.7 |
| | Specific gravity | g/cm$^3$ | 0.941 | 0.941 | 0.951 | 0.951 |
| Fiber property | Mw (fiber) | — | 3,300,000 | 3,300,000 | 115,000 | 115,000 |
| | Mw/Mn (fiber) | — | 6.3 | 6.3 | 2.3 | 2.2 |
| | Tensile strength | cN/dtex | 31.2 | 28.2 | 18.2 | 14.3 |
| | Modulus | cN/dtex | 1,044 | 960 | 820 | 580 |
| | Number of pores per unit of cross-sectional area | pore/μm$^2$ | 0 | 0 | 0.02 | 0.01 |
| | Pore average diameter | nm | — | — | 4 | 2 |
| | Porosity | % | 0.1 | 0.01 | 1.1 | 0.2 |
| | Exhaustion rate | % | 14 | 14 | 14 | 13 |
| | Thermal conductivity | W/mK | 79 | 88 | 66 | 73 |
| | Organic substance content in fiber | mass % | 0.1 | 0 | 0 | 0.1 |
| | Specific gravity, 5 hours later | | 0.975 | 0.971 | 0.931 | 0.942 |
| | Specific gravity, 24 hours later | | 0.975 | 0.971 | 0.932 | 0.942 |
| Evaluation of Gloves | Cut resistance Index value | — | 6.1 | 6.4 | 3.6 | 3.6 |

TABLE 1-2-continued

| | | unit | Comparative Example 5 | Comparative Example 6 | Comparative Example 7 | Comparative Example 8 |
|---|---|---|---|---|---|---|
| Spinning condition | Mesh diameter of nozzle filter | μm | 200 | Without filter | Without filter | 200 |
| | Innert gas pressure | MPa | 0.05 | 0.15 | 0.05 | 0.05 |
| | Single hole throughput | g/min | 0.5 | 0.5 | 0.5 | 0.5 |
| 1st drawing step condition | Drawing temperature | ?C | 90 | 40 | 100 | 25 |
| | Drawing ratio | — | 2.0 | 1.1 | 2.0 | 2.8 |
| 2nd drawing step condition | Drawing temperatue | ?C | 115 | 100 | 115 | 115 |
| | Drawing ratio | — | 3.8 | 5.0 | 7.0 | 5.0 |
| Raw resin property | Limiting viscosity | dL/g | 1.9 | 1.1 | 1.8 | 1.8 |
| | Specific gravity | $g/cm^3$ | 0.952 | 0.945 | 0.951 | 0.953 |
| Fiber property | Mw (fiber) | — | 121,500 | 52,000 | 115,000 | 115,000 |
| | Mw/Mn (fiber) | — | 5.1 | 8.2 | 2.2 | 2.3 |
| | Tensile strength | cN/dtex | 7.8 | 5.2 | 18.2 | 17.6 |
| | Modulus | cN/dtex | 322 | 290 | 820 | 740 |
| | Number of pores per unit of cross-sectional area | $pore/\mu m^2$ | 0.02 | 0 | 0 | 0.01 |
| | Pore average diameter | nm | 3 | — | — | 35 |
| | Porosity | % | 0.3 | 0.5 | 0.8 | 1.1 |
| | Exhaustion rate | % | 13 | 8 | 9 | 13 |
| | Thermal conductivity | W/mK | 74 | 69 | 73 | 71 |
| | Organic substance content in fiber | mass % | 0 | 0 | 0 | 0 |
| | Specific gravity, 5 hours later | | 0.944 | 0.955 | 0.960 | 0.930 |
| | Specific gravity, 24 hours later | | 0.944 | 0.955 | 0.961 | 0.931 |
| Evaluation of Gloves | Cut resistance Index value | — | 3.1 | 2.8 | 3.8 | 3.6 |

TABLE 2

| | | Color fastness test | | | | | | | | | |
|---|---|---|---|---|---|---|---|---|---|---|---|
| | | Example 6-1 | | Example 6-2 | | Example 6-3 | | Example 6-4 | | Example 6-5 | |
| | | Fiber | | | | | | | | | |
| | | Example 1 | | Example 2 | | Example 3 | | Example 4 | | Example 5 | |
| Evaluation method | Kind | Blue | Black | Blue | Black | Blue | Black | Blue | Black | Blue | Black |
| Washing | Color change and fading (grade) | 4 | 4 | 4 | 4 | 4 | 4 | 4 | 3 | 4 | 4 |
| JIS-L-0844 Method A-1 | Staining cotton (grade) | 5 | 4 | 5 | 4 | 5 | 4 | 4 | 3 | 4 | 4 |
| | Staining PET (grade) | 5 | 5 | 5 | 5 | 5 | 5 | 4 | 3 | 5 | 5 |
| Rubbing | Staining in dry state (grade) | 4 | 4 | 4 | 4 | 4 | 4 | 4 | 3 | 4 | 4 |
| JIS-L-0849, Type II | Staining in wet state (grade) | 5 | 4 | 5 | 4 | 5 | 4 | 4 | 3 | 5 | 4 |
| Perspiration (acidic) | Color change and fading (grade) | 5 | 4 | 5 | 4 | 5 | 4 | 4 | 3 | 5 | 4 |
| JIS-L-0848 | Staining cotton (grade) | 5 | 3 | 5 | 3 | 5 | 3 | 4 | 3 | 4 | 3 |
| | Staining PET (grade) | 5 | 3 | 5 | 3 | 5 | 3 | 4 | 3 | 4 | 3 |
| Perspiration (akaline) | Color change and fading (grade) | 5 | 4 | 5 | 4 | 5 | 4 | 4 | 3 | 5 | 4 |
| JIS-L-0848 | Staining cotton (grade) | 5 | 3 | 5 | 3 | 5 | 3 | 4 | 3 | 5 | 3 |
| | Staining PET (grade) | 4 | 4 | 4 | 4 | 4 | 4 | 4 | 4 | 4 | 4 |
| Dry cleaning | Color change and fading (grade) | 4 | 3 | 4 | 3 | 4 | 3 | 3 | 3 | 4 | 3 |
| (perch broethylene) JIS-L-0860 Method A-1 | Multiple staining (grade) | 4 | 5 | 4 | 5 | 4 | 5 | 3 | 3 | 4 | 5 |
| Dry cleaning | Color change and fading (grade) | 5 | 3 | 5 | 3 | 5 | 3 | 4 | 3 | 5 | 3 |
| (Petroleum-based) JIS-L-0860 Method B-1 | Multiple staining (grade) | 4 | 5 | 4 | 5 | 4 | 5 | 3 | 4 | 4 | 5 |

INDUSTRIAL APPLICABILITY

The polyethylene fiber of the present invention has a high mechanical strength, and enables a practical dyed product to be formed by using a generally used simple dyeing method. Therefore, the polyethylene fiber of the present invention can be used for applications for which coloring by dyeing has been conventionally abandoned. Further, the polyethylene fiber of the present invention is suitable for woven/knitted textiles using the polyethylene fiber of the present invention, woven/knitted textiles for applications for which a protective properties such as cut-resistance is required, and further woven/knitted textiles for applications for which colorful characteristics as well as the protective properties are required, and the polyethylene fiber of the present invention greatly contributes to industry.

DESCRIPTION OF THE REFERENCE CHARACTERS

1. Portions including pores

The invention claimed is:

1. A polyethylene fiber comprising a polyethylene, wherein the polyethylene has an intrinsic viscosity [η] of greater than or equal to 0.8 dL/g, and less than 5 dL/g, and substantially contains ethylene as a repeating unit, the polyethylene fiber comprises pores formed inside of the fiber, the average diameter of the pores is in the range of from 3 nm to 200 nm when the diameter is measured, by each pore being approximated by a column, at a contact angle of 140 degrees, in a mercury intrusion method, the porosity of the fiber is in the range of from 1.5% to 15%, and the polyethylene fiber has a tensile strength greater than or equal to 8 cN/dtex.

2. The polyethylene fiber according to claim 1, wherein the thermal conductivity in a fiber axis direction at a temperature of 300 K is in the range of from 6 W/mK to 50 W/mK.

3. The polyethylene fiber according to claim 1, wherein the polyethylene fiber contains an organic substance having a high affinity for a disperse dye and a polyethylene.

4. The polyethylene fiber according to claim 1, wherein the weight average molecular weight (Mw) of the polyethylene is in the range of from 50,000 to 600,000, and the ratio (Mw/Mn) of the weight average molecular weight to the number average molecular weight (Mn) is less than or equal to 5.0.

5. The polyethylene fiber according to claim 1, wherein the specific gravity of the polyethylene fiber is greater than or equal to 0.90, and the modulus of the polyethylene fiber is in the range of from 200 cN/dtex to 750 cN/dtex.

6. A dyed polyethylene fiber comprising the polyethylene fiber as defined in claim 3, wherein the polyethylene fiber is dyed with a disperse dye.

7. The dyed polyethylene fiber according to claim 6, wherein the evaluation value of a fastness to washing in compliance with JIS L-0844 A-1 or the evaluation value of a fastness to dry cleaning in compliance with JIS L-0860 A-1 of the dyed polyethylene fiber is higher than or equal to grade 3.

8. A covered elastic yarn comprising an elastic fiber being covered by the polyethylene fiber as defined in claim 3.

9. The polyethylene fiber according to claim 2, wherein the polyethylene fiber contains an organic substance having a high affinity for a disperse dye and a polyethylene.

10. The polyethylene fiber according to claim 2, wherein the weight average molecular weight (Mw) of the polyethylene is in the range of from 50,000 to 600,000, and the ratio (Mw/Mn) of the weight average molecular weight to the number average molecular weight (Mn) is less than or equal to 5.0.

11. The polyethylene fiber according to claim 2, wherein the specific gravity of the polyethylene fiber is greater than or equal to 0.90, and the modulus of the polyethylene fiber is in the range of from 200 cN/dtex to 750 cN/dtex.

12. The polyethylene fiber according to claim 1, wherein the polyethylene fiber comprises pores inside the fiber that communicate with the surface of the fiber.

13. The polyethylene fiber according to claim 1, wherein the polyethylene fiber is manufactured by a manufacturing method including a drawing process step, the drawing process step comprising drawing a non-drawn filament comprising the polyethylene at a deformation rate of greater than or equal to 0.05 m/sec.

14. The polyethylene fiber according to claim 3, wherein the exhaustion rate of the polyethylene fiber is greater than or equal to 17%, and the exhaustion rate is obtained when dyeing is performed at 100° C. at a bath ratio of 1:100 for 90 minutes by using a dye liquor that is prepared to have such a concentration as to contain 0.4 g/L of the disperse dye.

15. The polyethylene fiber according to claim 3, wherein the organic substance having the high affinity for the disperse dye and the polyethylene contains at least one polyether compound having a molecular weight greater than or equal to 500.

16. The polyethylene fiber according to claim 3, wherein the proportion of the organic substance to the polyethylene fiber is in the range of from 0.005 mass % to 10.0 mass %.

17. A protective woven/knitted textile comprising, as at least a portion of the protective woven/knitted textile, the polyethylene fiber as defined in claim 3, wherein the protective woven/knitted textile has an index value of a coup tester of greater than or equal to 3.9.

18. A cut-resistant glove comprising the protective woven/knitted textile as defined in claim 17.

* * * * *